US011062602B1

(12) United States Patent
Beaurepaire et al.

(10) Patent No.: US 11,062,602 B1
(45) Date of Patent: Jul. 13, 2021

(54) METHOD AND APPARATUS FOR RECOMMENDING TEMPORARY PARKING

(71) Applicant: HERE Global B.V., Eindhoven (NL)

(72) Inventors: Jerome Beaurepaire, Berlin (DE); Leon Stenneth, Chicago, IL (US); Jeremy Michael Young, Chicago, IL (US)

(73) Assignee: HERE Global B.V., Eindhoven (NL)

( * ) Notice: Subject to any disclaimer, the term of this patent is extended or adjusted under 35 U.S.C. 154(b) by 0 days.

(21) Appl. No.: 16/864,986

(22) Filed: May 1, 2020

(51) Int. Cl.
*G08G 1/14* (2006.01)
*G08G 1/01* (2006.01)

(52) U.S. Cl.
CPC ..... *G08G 1/146* (2013.01); *G08G 1/0129* (2013.01); *G08G 1/0133* (2013.01); *G08G 1/144* (2013.01)

(58) Field of Classification Search
CPC ..... G06Q 50/30; G06Q 10/083; G06Q 30/02; G06Q 30/0207; G06Q 30/0241; G06Q 10/00; G06Q 10/0836; G06Q 10/1095; G06Q 30/0265; G06Q 50/01; G01C 21/3484; G01C 21/3697; G01C 21/3626; G01C 21/3641; G01C 21/34; G01C 21/3605; G01C 21/3407; G01C 21/3415; G01C 21/3423; G01C 21/343; G01C 21/3446; G01C 21/3453; G01C 21/3461; G01C 21/3492; G01C 21/3617; G01C 21/3629; G01C 21/3652; G01C 21/3655; G08G 1/0112; G08G 1/0129; G08G 1/0141; G08G 1/144; G08G 1/147; G08G 1/0137; G08G 1/04; G08G 1/096844; G08G 1/133; G08G 1/143; G08G 1/146; G08G 1/207; G08G 1/096775; G08G 1/0133; G08G 1/0962; G08G 1/096716; G08G 1/096741; G08G 1/09675; H04W 4/027; H04W 4/029; H04W 4/12; H04W 16/00; H04W 16/18; H04W 24/02; H04W 4/40; H04W 4/48; H04W 4/50; H04W 64/003;

(Continued)

(56) References Cited

U.S. PATENT DOCUMENTS 8,063,797 B1 * 11/2011 Sonnabend ..... G08G 1/04 340/932.2
8,515,641 B2 8/2013 Riegel
(Continued)

OTHER PUBLICATIONS

Riu et al. "Designing Dynamic Delivery Parking Spots in Urban Areas to Reduce Traffic Disruptions", Research Article, Journal of Advanced Transportation, vol. 2017, Article ID 6296720, Aug. 29, 2017, 16 pages.

*Primary Examiner* — Daniel Previl
(74) *Attorney, Agent, or Firm* — Ditthavong, Steiner & Mlotkowski

(57) ABSTRACT

An approach is provided for providing a temporary parking recommendation based on a risk of hindering parking space usage. The approach involves determining parking data for the one or more parking areas that are within a designated proximity of a location in a road network. The approach also involves calculating a parking score for the location based on the parking data. The parking score represents a risk that a vehicle parking at the location will hinder at least one other vehicle when the at least one other vehicle attempts to enter or exit the one or more parking areas. The approach further involves providing the parking score as an output.

20 Claims, 16 Drawing Sheets

(58) Field of Classification Search
CPC ... H04W 84/005; H04W 88/08; H04W 12/02; H04W 4/023; H04W 4/024; H04W 4/35; H04W 4/44; G06K 9/00818; G06K 9/00791; G06K 9/00476; G06K 9/3258; H04M 1/72577; H04M 1/72569; H04M 1/72572; H04M 1/6075; H04M 1/67; H04M 2250/12; H04M 2250/22; H04L 67/12; H04L 2209/38; H04L 9/0643; G06F 16/29; G06F 21/36; G06N 20/00; G06N 7/005; G07B 15/02
USPC ... 340/932.2, 933, 937, 992, 995.12–995.15, 340/995.22, 995.25
See application file for complete search history.

(56) References Cited

U.S. PATENT DOCUMENTS

| | | | | |
|---|---|---|---|---|
| 10,423,162 | B2 * | 9/2019 | Yalla | G08G 1/149 |
| 10,529,234 | B2 | 1/2020 | Levy et al. | |
| 2014/0132767 | A1 * | 5/2014 | Sonnabend | G06K 9/00476 348/148 |
| 2016/0012726 | A1 | 1/2016 | Wang | |
| 2017/0267233 | A1 * | 9/2017 | Minster | B62D 15/02 |
| 2018/0053237 | A1 * | 2/2018 | Hayes | G08G 1/0141 |
| 2018/0194344 | A1 * | 7/2018 | Wang | G05D 1/0257 |
| 2018/0304926 | A1 * | 10/2018 | Ghose | B62D 15/027 |

* cited by examiner

540

700

METHOD AND APPARATUS FOR RECOMMENDING TEMPORARY PARKING

BACKGROUND

Mapping and navigation service providers are continually challenged to provide compelling services and applications. One area of development is providing parking guidance information particularly in crowded areas such as city centers, business districts, and/or the like. In particular, vehicles that need to stop or stand at a location only temporarily (e.g., delivery vehicles, vehicles picking up/dropping off passengers, etc.) may find it difficult to find stopping or standing locations (e.g., temporary parking locations) in areas where parking spaces are limited or otherwise occupied. As a result, service providers face significant technical challenges to determining and presenting information on temporary parking locations.

SOME EXAMPLE EMBODIMENTS

Therefore, there is a need for an approach for providing a parking recommendation (e.g., recommended temporary stopping or standing locations) based on a risk of hindering other vehicles from using nearby parking spaces.

According to one embodiment, a method for providing a parking recommendation based on hindering one or more parking spots comprises determining parking data (e.g., parking churn or turnover rate) for the one or more parking areas that are within a designated proximity of a location in a road network. The method also comprises calculating a parking score for the location based on the parking data. The parking score represents a risk that a vehicle parking at the location will hinder at least one other vehicle when the at least one other vehicle attempts to enter or exit the one or more parking areas. The method further comprises providing data for presenting the parking score as an output.

According to another embodiment, an apparatus providing a parking recommendation based on hindering one or more parking spots comprises at least one processor, and at least one memory including computer program code for one or more computer programs, the at least one memory and the computer program code configured to, with the at least one processor, cause, at least in part, the apparatus to determine parking data (e.g., parking churn or turnover rate) for the one or more parking areas that are within a designated proximity of a location in a road network. The apparatus also is caused to calculate a parking score for the location based on the parking data. The parking score represents a risk that a vehicle parking at the location will hinder at least one other vehicle when the at least one other vehicle attempts to enter or exit the one or more parking areas. The apparatus further is caused to provide data for presenting the parking score as an output.

According to another embodiment, a non-transitory computer-readable storage medium providing a parking recommendation based on hindering one or more parking spots carries one or more sequences of one or more instructions which, when executed by one or more processors, cause, at least in part, an apparatus to determine parking data (e.g., parking churn or turnover rate) for the one or more parking areas that are within a designated proximity of a location in a road network. The apparatus also is caused to calculate a parking score for the location based on the parking data. The parking score represents a risk that a vehicle parking at the location will hinder at least one other vehicle when the at least one other vehicle attempts to enter or exit the one or more parking areas. The apparatus further is caused to provide data for presenting the parking score as an output.

According to another embodiment, an apparatus comprises means for determining parking data (e.g., parking churn or turnover rate) for the one or more parking spots that are within a designated proximity of a location in a road network. The apparatus also comprises means for calculating a parking score for the location based on the parking data. The parking score represents a risk that a vehicle parking at the location will hinder at least one other vehicle when the at least one other vehicle attempts to enter or exit the one or more parking spots. The apparatus further comprises means for providing data for presenting the parking score as an output.

In addition, for various example embodiments of the invention, the following is applicable: a method comprising facilitating a processing of and/or processing (1) data and/or (2) information and/or (3) at least one signal, the (1) data and/or (2) information and/or (3) at least one signal based, at least in part, on (or derived at least in part from) any one or any combination of methods (or processes) disclosed in this application as relevant to any embodiment of the invention.

For various example embodiments of the invention, the following is also applicable: a method comprising facilitating access to at least one interface configured to allow access to at least one service, the at least one service configured to perform any one or any combination of network or service provider methods (or processes) disclosed in this application.

For various example embodiments of the invention, the following is also applicable: a method comprising facilitating creating and/or facilitating modifying (1) at least one device user interface element and/or (2) at least one device user interface functionality, the (1) at least one device user interface element and/or (2) at least one device user interface functionality based, at least in part, on data and/or information resulting from one or any combination of methods or processes disclosed in this application as relevant to any embodiment of the invention, and/or at least one signal resulting from one or any combination of methods (or processes) disclosed in this application as relevant to any embodiment of the invention.

For various example embodiments of the invention, the following is also applicable: a method comprising creating and/or modifying (1) at least one device user interface element and/or (2) at least one device user interface functionality, the (1) at least one device user interface element and/or (2) at least one device user interface functionality based at least in part on data and/or information resulting from one or any combination of methods (or processes) disclosed in this application as relevant to any embodiment of the invention, and/or at least one signal resulting from one or any combination of methods (or processes) disclosed in this application as relevant to any embodiment of the invention.

In various example embodiments, the methods (or processes) can be accomplished on the service provider side or on the mobile device side or in any shared way between service provider and mobile device with actions being performed on both sides.

For various example embodiments, the following is applicable: An apparatus comprising means for performing the method of any of the claims.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings.

DESCRIPTION OF SOME EMBODIMENTS

Examples of a method, apparatus, and computer program for providing a temporary parking recommendation based on a risk of hindering parking space usage are disclosed. In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement. In other instances, well-known structures and devices are shown in block diagram form in order to avoid unnecessarily obscuring the embodiments of the invention.

As used herein, the term "temporary parking recommendation" refers to a recommendation for a location or an area where a vehicle can park, stop, stand, etc. for less than a designated period of time (e.g., 15 minutes, 30 minutes, etc.) or for a duration of a limited designated purpose (e.g., for making a delivery, picking up/dropping off a passenger, etc.). In one embodiment, the location/area that can be recommended for temporary parking can be any location/area on or within a designated threshold of a road network or other pathways supporting vehicular travel. These locations, for instance, can include locations/areas that have not been previously designated as parking spaces as well as those locations/areas that have been designated as parking spaces or areas. Moreover, the term "temporary parking recommendation" is used interchangeably with "parking recommendation" in the embodiments described herein.

As used herein, the term "vehicle" refers to is a mode of transport for people or cargo, such as motor vehicles (e.g., cars, trucks, buses, motorcycles, etc.), bicycles, railed vehicles (e.g., trains, trams, etc.), watercraft (e.g., ships, boats, etc.), aerial vehicles (e.g., airplanes, helicopters, drones, etc.), and spacecraft, etc.

As used herein, the term "parking space" refers to a location that has been used for parking a vehicle, either designated or undesignated for vehicle parking/standing/stopping, either paved or unpaved. It can be in a parking garage, in a parking lot or on a private or public street, over a bicycle lane, sidewalk, grass verges or other places which are not designed for vehicle parking/standing/stopping, etc. The space may or may not be delineated by road surface markings. The vehicle fits inside the space, either by parallel parking, perpendicular parking or angled parking. Although various embodiments are described with respect to land/terrestrial vehicles, it is contemplated that the approach described herein may be used with other vehicles, such as watercraft, aerial vehicles, spacecraft, etc.

Figure 1:
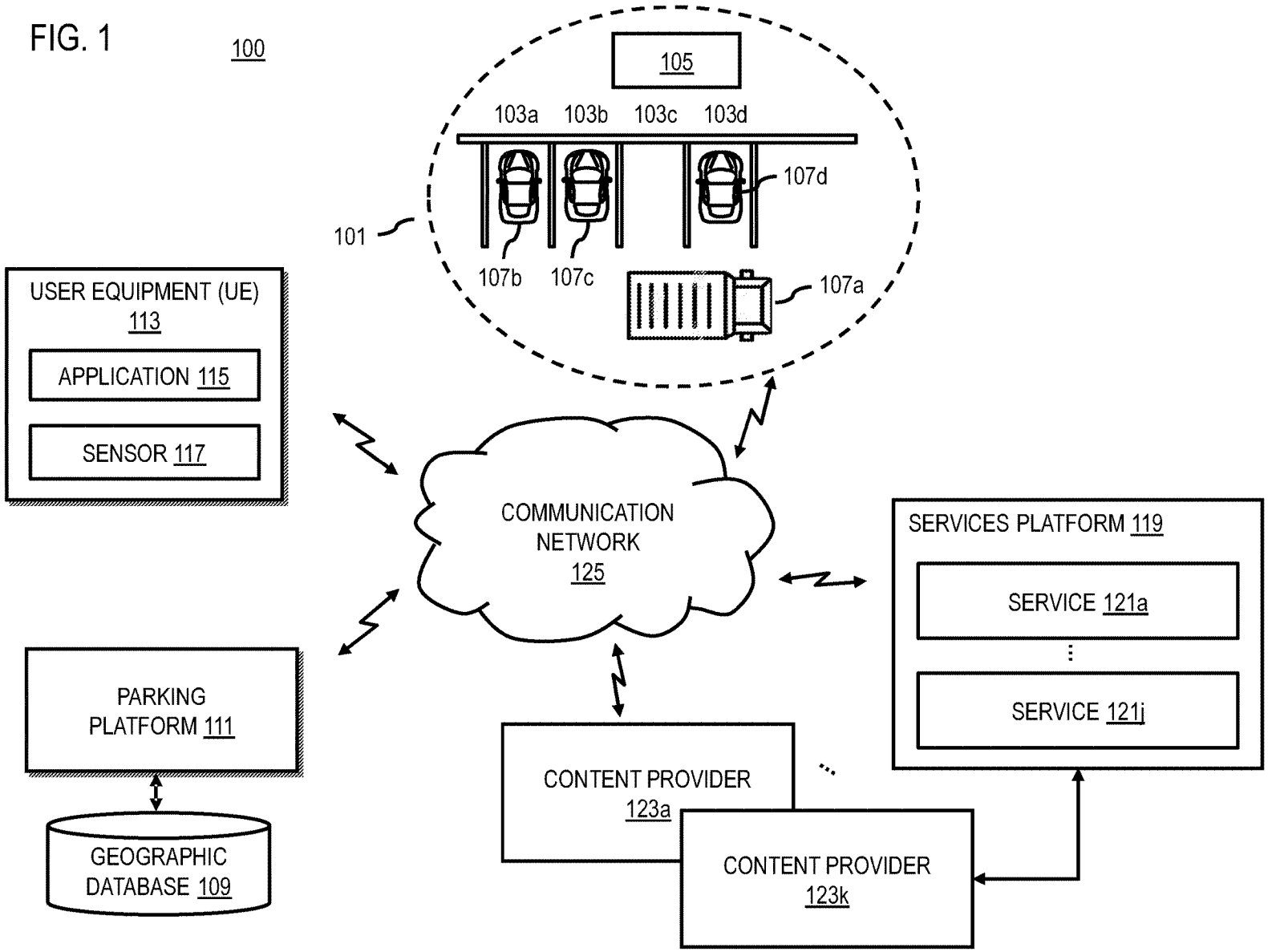
FIG. 1 is a diagram of a system for providing a temporary parking recommendation based on a risk of hindering parking space usage, according to one embodiment.

FIG. 1 is a diagram of a system for providing a temporary parking recommendation based on a risk of hindering parking space usage, according to one embodiment. Providing mapping and navigation data (e.g., including data on where to park) options is an area of interest for service providers, original equipment manufacturers (OEMs), and/other navigation related companies (e.g., advanced driver assistance systems (ADAS)). For example, looking for parking (e.g., on-street parking), particularly in urban or congested areas, can be stressful and difficult for commercial vehicle drivers, such as a delivery truck driver. In most cases, most parking spaces and loading/unloading spots are taken or otherwise unavailable such that delivery vehicles have to double-park on the streets or parking lots thereby causing road traffic disturbance. However, double parking can hinder the ability of other vehicles to enter or exit from parking spaces that affected by the double parking. This, in turn, can lead increase traffic, poor user experience, etc. at the location. Therefore, service providers face significant technical challenges with respect providing temporary parking recommendations and related guidance data in a way that minimizes adversely affecting access to nearby parking spaces.

To address these technical challenges, a system 100 of FIG. 1 introduces a capability of providing a temporary parking recommendation to a vehicle based on a risk of hindering other vehicles' attempt to enter or exit nearby parking spaces. In one embodiment, the system 100 gathers parking event data (e.g., historical and/or real-time data) for a geographic area 101 (e.g., including parking spaces 103*a*-103*d*—also collectively referred to as parking spaces 103). The historical parking event data can include, but is not limited, to data indicating the occupancy/usage rates, churn/turnover rate (e.g., how often cars are entering or exiting the parking spaces 103 or otherwise parking within the geographic area of interest), and/or any equivalent parking metric. In one embodiment, the parking event data can be stratified according to different contextual parameters such as but not limited to time of day, day of the week, month, season, etc. The geographic area 101 may span any geographic boundary (e.g., neighborhoods, cities, regions, etc.) of interest and may include a variety of road links and/or parking spaces 103.

In one example use case, the geographic area 101 can be defined based on a designated radius from a point of interest 105 for a target vehicle 107*a* (e.g., delivery vehicle) to make a delivery at the point of interest 105. In other use case, the vehicle 107*a* can be any vehicle that is searching for a temporary parking location (e.g., a shared vehicle or taxi that is dropping off and/or picking up passengers). In one embodiment, a temporary parking location is a location anywhere within the geographic area 101 or the road network in general at which the vehicle 107*a* can temporarily park, stop, or stand for less than a designated period of time or a duration of a limited purpose (e.g., time needed to make a delivery, pick up/drop off a passenger, etc.). As shown in the example of FIG. 1, most of the parking spaces 103 (e.g., spaces 103*a*, 103*b*, and 103*d*) are taken by other vehicles 107*b*-107*d* while the parking space 103*c* is unoccupied but is too small to fit the vehicle 107*a*. As a result, the vehicle 107*a* needs the system 100 to recommend the best location to temporarily park (e.g., by double parking). In one embodiment, to respond to this need, the system 100 can process the historical parking data determine one or more potential temporary parking locations at which the vehicle 107*a* can park while minimizing the corresponding hindrance of other vehicles in the geographic area 101 (e.g., hindrance of the ability of the other vehicles including the vehicles 107*b*-107*d* from entering or exiting the parked spaces 103 that may be blocked the vehicle 107*a* when parked at the recommended temporary location. The temporary parking location, for instance, can be a location which has not been previously designated as a parking space (e.g., a location where the vehicle 107*a* may be double parked. For example, if the vehicle 107*a* temporarily double parks at the location shown in FIG. 1, it will block the vehicle 107*d* from leaving the space 103*d* while blocking other vehicles from parking in the space 103*c*.

Due to the highly dynamic nature of parking occupancy of relevant parking spaces 103 and/or mobility patterns of vehicles in the geographic area 101 of interest, the system 100 can gather and process static and dynamic data sets (e.g., including parking data, etc.) to find the optimal temporary parking locations (e.g., temporary parking locations which least hinder access to nearby parking spaces 103 depending on parking space attributes, vehicle attributes, delivery attributes, driver/passenger attributes, POI attributes, traffic attributes, weather attributes, etc. In one embodiment, the optimal temporary parking recommendation can be calculated for a general or non-specific vehicle or personalized for the specific target vehicle 107*a* (e.g., a delivery vehicle, a ride hailing vehicle, a private car, etc.) and/or the functions or other attributes of the target vehicle 107*a*. Various embodiments of the process are described below.

In one embodiment, the system 100 combines various static and dynamic location based sensor data to train a parking score model (e.g., a machine learning model) in order to generate a scoring model which minimizes the disruption for nearby vehicles. The system 100 then recommends the most suitable parking location based on the computed parking score.

The static and dynamic location based sensor data may include delivery attributes (e.g., weights, sizes, pickup/drop-off locations of packages to be delivered, etc.), vehicle attributes (e.g., models, weights, sizes, maneuverability, origins/destinations, mobility graphs, etc. of the vehicles 107*a*-107*d*, collectively vehicles 107), POI attributes (e.g., operation hours, entry/exit/loading locations, etc.), road attributes (e.g., road dimensions, shapes, directionality, traffic of road links near the POI, land attributes, etc.), parking space attributes (e.g., designated or not, paved or not, parking restrictions (e.g., handicapped parking spaces, emergency infrastructure including fire hydrants, temporary event parking limits including street fairs, festival, etc.), fee or free, churn rates, occupancy patterns, etc.), passenger attributes (e.g., preference data, with special needs or not, etc.), weather attributes (e.g., line of sight/visibility, surface slippery or not, etc.), population density, etc. The static and dynamic location based sensor data may be retrieved from various local and/or external databases. For example, the system 100 can obtain the POI attributes, the road attributes, parking space attributes, etc. from a geographic database 109.

In another embodiment, the system 100 partitions a road network (e.g., into a grid), calculates parking scores assigned to each space in the grid (e.g., per square meter), and generates a map (e.g., a heatmap) with the parking scores.

Figure 2:
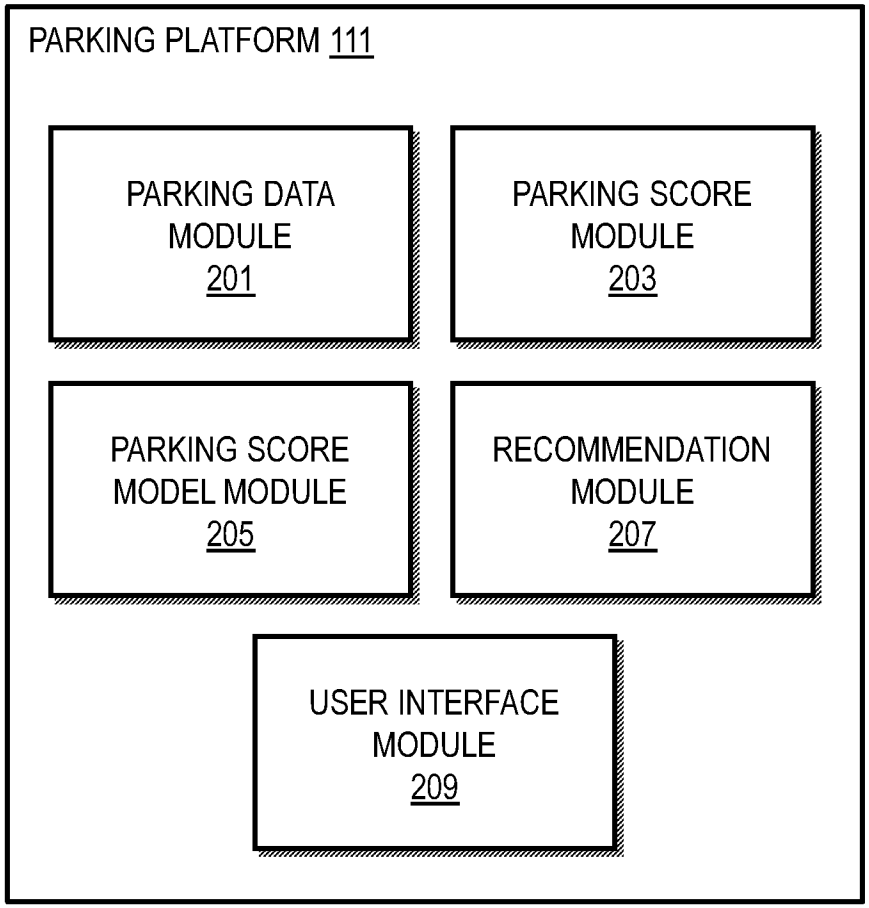
FIG. 2 is a diagram of the components of a parking platform, according to one embodiment.

FIG. 2 is a diagram of the components of a parking platform 111, according to one embodiment. By way of example, the parking platform 111 includes one or more components for computing a parking score based on a risk of hindering parking space usage according to the various embodiments described herein. It is contemplated that the functions of these components may be combined or performed by other components of equivalent functionality. In this embodiment, the parking platform 111 includes a parking data module 201, a parking score module 203, a parking score model module 205, a recommendation module 207, and a user interface (UI) module 209. The above presented modules and components of the parking platform 111 can be implemented in hardware, firmware, software, or a combination thereof. Though depicted as a separate entity in FIG. 1, it is contemplated that the parking platform 111 may be implemented as a module of any of the components of the system 100 (e.g., a component of the vehicle 107*a*, navigation system of the vehicle 107*a*, UE 113, and/or application 115 in UE 113). In another embodiment, one or more of the modules 201-209 may be implemented as a cloud based service, local service, native application, or combination thereof. The functions of these modules are discussed with respect to FIGS. 3-8 below.

Figure 3:
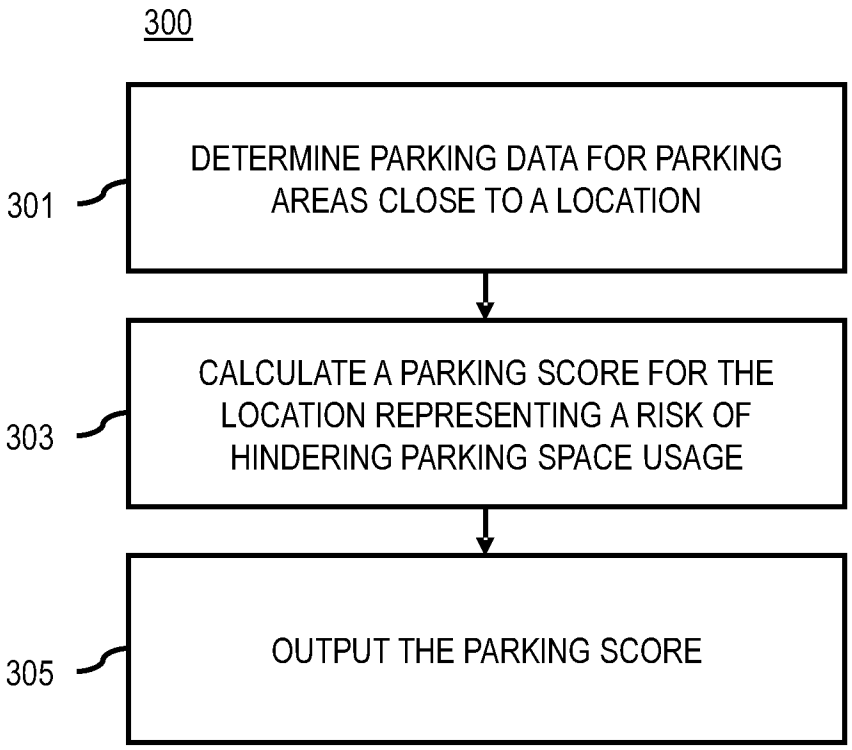
FIG. 3 is a diagram of a process for providing a temporary parking recommendation based on a risk of hindering parking space usage, according to one embodiment.
Figure 10:
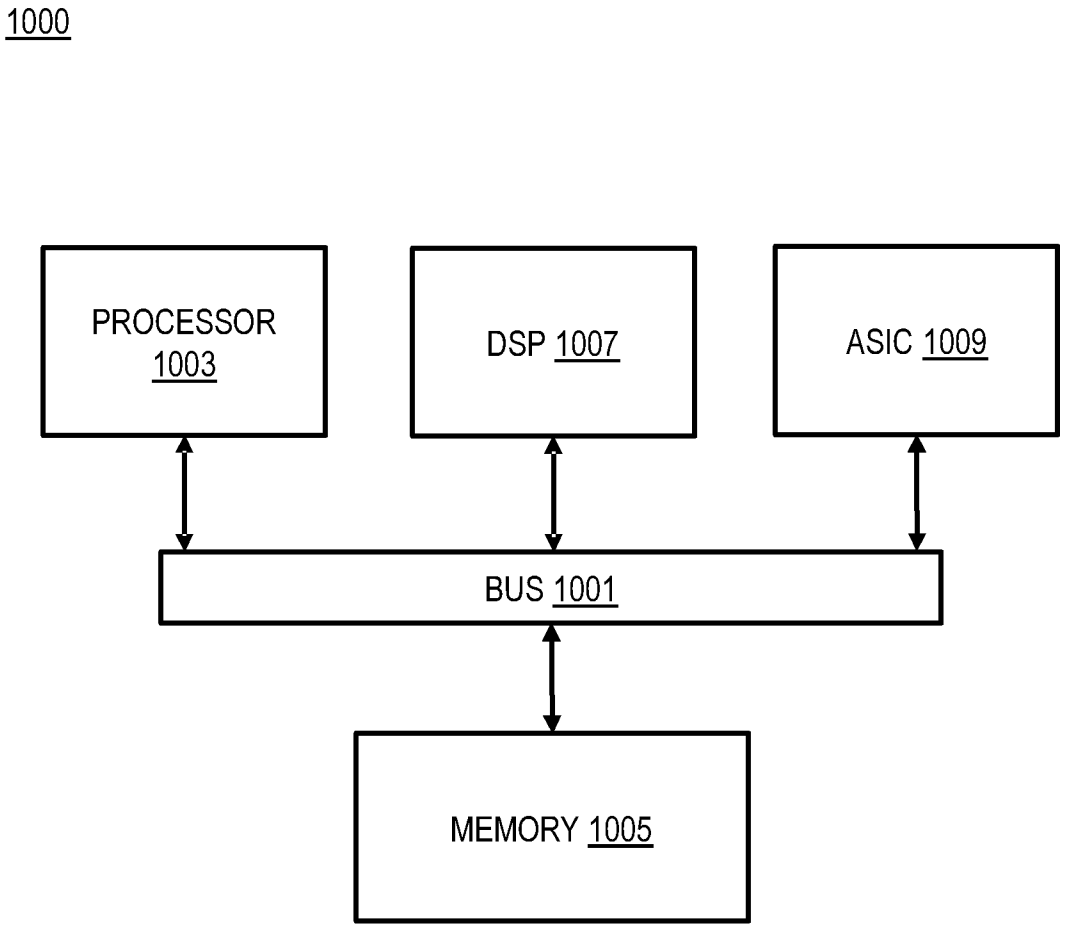
FIG. 10 is a diagram of a chip set that can be used to implement an embodiment.

FIG. 3 is a diagram of a process for providing a temporary parking recommendation based on a risk of hindering parking space usage, according to one embodiment. In various embodiments, the parking platform 111 and/or any of the modules 201-209 of the parking platform 111 as shown in FIG. 2 may perform one or more portions of the process 300 and may be implemented in, for instance, a chip set including a processor and a memory as shown in FIG. 10. As such, the parking platform 111 and/or any of the modules 201-209 can provide means for accomplishing various parts of the process 300, as well as means for accomplishing embodiments of other processes described herein in conjunction with other components of the system 100. Although the process 300 is illustrated and described as a sequence of steps, its contemplated that various embodiments of the process 300 may be performed in any order or combination and need not include all of the illustrated steps.

In one embodiment, in step 301, the parking data module 201 determines parking data for one or more parking areas that are within a designated proximity of a location in a road network. By way of example, the location may be a location of interest as indicated by the driver via a user interface associated with the vehicle 107*a* and/or UE 113. In another embodiment, the location may be an optimal parking location to be automatically recommended to the vehicle 701*a*, e.g., when the vehicle 107*a* slows down to a threshold speed, or approaches to a frequently stopped point of interest, etc.

Figure 4B:
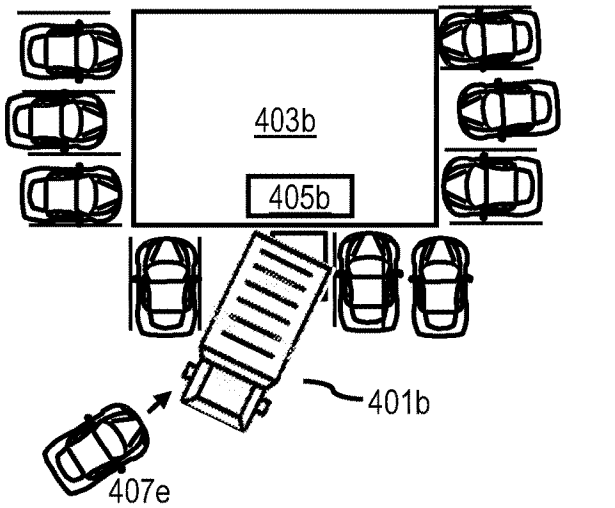
FIGS. 4A-4D are diagrams illustrating parking scenarios requiring parking recommendations, according to various embodiments.
Figure 4D:
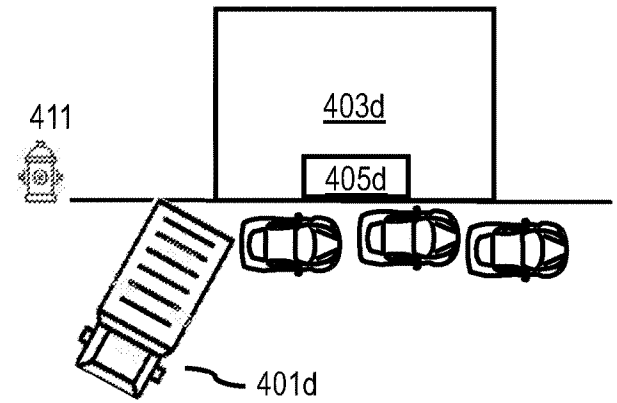
Figure 4A:
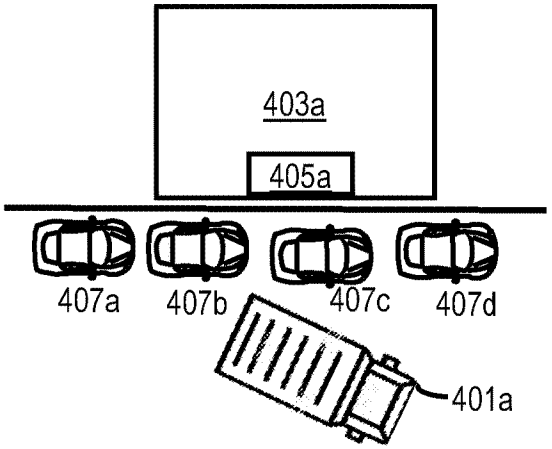

By way of example, FIG. 4A is a diagram illustrating a parking scenario requiring a temporary parking recommendation, according to one embodiment. In FIG. 4A, a vehicle 401*a* sought to park near a point of interest 403*a* (e.g., a store) with an entrance 405*a* to unload some products. However, there are already vehicles 407*a*-407*d* parked in front of the entrance 405*a*, such that the vehicle 401*a* is forced to double park next to the vehicles 407*b*-407*c*.

Figure 4C:
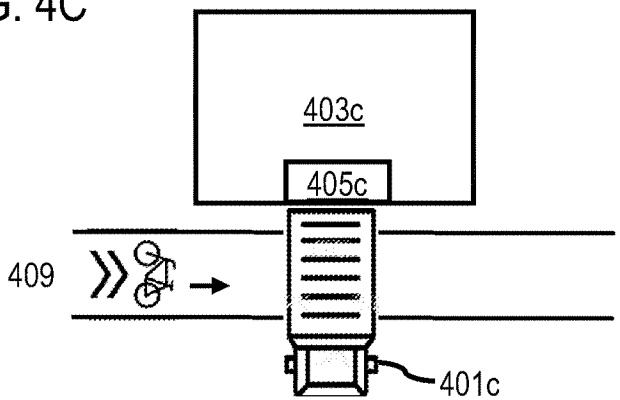

FIGS. 4B-4D are diagrams illustrating other parking scenarios requiring parking recommendations, according to various embodiments. In FIG. 4B, a vehicle 401*b* parks in front of an entrance 405*b* of a point of interest 403*b* (e.g., a hotel) to pick up some passengers with heavy luggage. However, the vehicle 401*b* blocks another vehicle 407*e* to drop off guests at the entrance 405*b*. In FIG. 4C, a vehicle 401*c* parks over a bicycle lane 409 in front of an entrance 405*c* of a point of interest 403*c* (e.g., a house) to delivery package, which potentially blocks bicycles. In FIG. 4D, a vehicle 401*d* parks on a street in front of an entrance 405*d* of a point of interest 403*d* (e.g., an apartment) to drop off a ride-sharing passenger, which is within 15 feet of a fire hydrant 411.

It is noted that the examples of FIG. 4A-4D are provided by way of illustration and not as limitations. It is contemplated that any number or varieties of parking scenarios can be extracted from the historical parking event data for a given geographic area.

In one embodiment, the parking data module 201 processes trajectory data (e.g., probe data) associated with journeys of vehicles 107 and/or UE 113 (e.g., using big data analytics, artificial intelligence, etc.) to determine parking events of the vehicles 107. The parking data module 201 can process the trajectory data to determine when a vehicle stopping time passing a threshold (e.g., 5 minutes) at a location. Via map matching, the parking data module 201 can classify whether the location is a parking space, and then aggregate the classified parking events into parking event data as a part of the parking data. When the location is mapped into a designated parking space (e.g., a marked parking spot) or an undesignated parking space (e.g., an unmarked street parking space), the relevant event data is recorded and aggregated into a database (e.g., the geographic database 109) as parking event data. On the other hand, when the location cannot be mapped into a designated or undesignated parking space, the relevant event data is discarded. For example, when a vehicle is trapped in traffic, the stop is not recorded as a parking event.

In another embodiment, the parking data module 201 can determine parking occupancy data (e.g., whether a parking space is occupied or not, and/or a probability that the parking space is occupied as a time function) over time (e.g., based on timestamp information associated with the trajectories) as a part of the parking data. The parking data module 201 can then determine how the parking occupancy data fluctuates or varies (e.g., between parking occupied or not occupied) over a predetermined period of time, i.e., a churn rate depending on movement of vehicles in and out of parking spaces between different parking events. The churn rate may be per designated parking space, or per road link containing one or more undesignated parking space. The churn rate may be generated in dependence of time of day, day of week, season of the year, special events, etc. as a part of the parking data.

In other embodiments, the parking data module 201 can determine parking event data, parking occupancy data, and/or churn rate data based on historical and/or real-time sensor data related to occupancy of parking spaces collected from various locations and/or POIs, such as data from motion sensors, inertia sensors, image capture sensors, proximity sensors, LIDAR (light detection and ranging) sensors, ultrasonic sensors, etc. Also, remote sensing, such as aerial or satellite photography, can be used to generate parking data directly or through machine learning (e.g., Bayes Net, Random Forest, Decision Trees, etc.).

The parking data may further include parking space attribute data, on-street parking zones and restrictions data, analytical estimates on average-time-to-park for different regions, statistical data previously computed related to performance and accuracy of parking recommendations, etc.

In yet other embodiments, the parking data module 201 retrieves parking event data, parking occupancy data, churn rate data, and/or other parking data (e.g., the historical and/or real-time sensor data from various locations or POIs) from one or more third party databases (e.g., real-time parking street management systems, etc.) then forward the data to other modules for further processing.

In step 303, the parking score module 203 calculates a parking score for the optimal parking location/area based on the parking data. The parking score represents a risk that a vehicle parking at the location will hinder at least one other vehicle when the at least one other vehicle attempts to enter or exit the one or more parking spots.

In one embodiment, the parking score module 203 processes mobility data associated with the optimal parking location, the road network, and/or the one or more parking areas and/or spots, to determine a predicted time when the at least one other vehicle is expected to enter or exit the one or more parking spots. The parking score is further based on the predicted time. Then after, the recommendation module 207 determines a temporary parking recommendation for the vehicle based on the parking score for the location.

By way of example, the vehicle is a delivery vehicle, and the recommendation module 207 recommends the parking location further based on at least one delivery attribute of the delivery vehicle. The at least one delivery attribute may include a package to be delivered, a location of a delivery, a size of the delivery vehicle, a next stop of the delivery vehicle, a maneuverability of the delivery vehicle, a line of sight of the delivery vehicle to the location of the delivery, etc.

In other embodiments, the recommended parking location may be not previously designated as a parking spot. Referring back to FIG. 4A, the recommendation module 207 recommends a double parking space for the vehicle 401*a* that arrives around Tuesday 2:00 pm. Since the vehicle 407*c* belongs to an owner of the store 403*a* (e.g., a restaurant) who rarely moves the vehicle 407*c* during store hours (weekdays 11 am to 9 pm), the vehicle 401*a* will not block the vehicle 407*c* at that time. However, the vehicle 401*a* will not block the vehicle 407*b* from exiting its space due to, e.g., limited maneuverability of the vehicle 407*b*. In this case, the parking score for the double parking spot is 0.1, i.e., 10% probability that the vehicle 401*a* can block the vehicle 407*b*. The maneuverability of different vehicle models from a corresponding parking space with respect to the size of the vehicle 401*a* can be considered when estimating which parked vehicles can be blocked by the vehicle 401*a*.

In other embodiments, the parking score module 203 further processes the following data to calculate the parking score: road attribute data, vehicle attribute data, vehicle task attribute data (e.g., package/passenger delivery), driver/passenger attribute data, traffic data, weather data, POI attributes, a population model of the location, etc. By way of example, weather data can include visibility, road surface slipperiness, weather variability, weather conditions requiring coverage (e.g., hail, tornado, thunder, etc.), etc. The parking score module 203 can improve the parking score for a covered location (e.g., under an overpass, etc.) since other vehicles will slow down or even stop at where they are, thus it becomes less likely for the target vehicle to hinder other vehicles' usage of the covered location.

In another embodiment, the recommended parking location is a designated parking spot. By way of example, the recommendation module 207 recommends the vehicle 401*b* to park over two designated parking spaces as the vehicle 401*b* arrives around Tuesday 5:45 am for the scenario shown in FIG. 4B. Since only one parking space is vacant while the remaining guest parking spaces are taken, and it is rare for hotel guests to check in during 1:00-6:00 am, there is 5% probability that the vehicle 401*b* can block the other vehicle 407*e* to enter a designated space around 6:00 am. In this case, the parking score for the recommended parking location is 0.05.

In another embodiment, the parking score model module 205 may apply machine learning, artificial intelligence, deep learning, etc. on the above-referenced data to identify different time-dependent parking occupancy patterns of areas of similar parking attributes, POI attributes, road attributes, etc. as clusters, and build a parking score model for faster parking data processing and parking score prediction for an area of interest.

By way of example, the parking score model is designed to solve a parking location search query that minimizes the disturbances for the parking space usage nearby. The model outputs one or more top-ranked searched parking spaces. In one embodiment, the model treats the query as a parametric-space search problem in which each 2D parking area is coded as a vector/matrix, and indexed by their corresponding sequence of parameter/attribute values as tokens. By way of example, the parking score model module 205 segments a road network into a plurality of geographic areas of an identical size (i.e., a grid). For instance, each parking area may be coded as [grid unit coordinates, grid unit size], while each parking event occurred in one grid unit is codes as a vector with values of [grid unit coordinates, grid unit size, parking starting time, parking end time, day of a week, vehicle model, vehicle task, etc.].

The parking score model module 205 can selectively include in the vector the following as a parameter and/or a weight factor for calculating the parking score: other parking data attributes, mobility data attributes, road attributes, other vehicle attributes, driver attributes, passenger attributes, traffic attributes, weather attributes, POI attributes, etc.

In one embodiment, the parking score model module 205 can cluster the areas based on the similarity of their respective parking vectors. As an example, the parking score model module 205 can apply dynamic time warping (DTW) or other equivalent clustering algorithm to cluster the areas with similar time-dependent parking occupancy patterns. The parking score model module 205 then applies training token values to generate respective parking scores for different clusters of geographic areas.

In one embodiment, the parking score is included in a representative vector of a cluster as a representative element of the time-dependent parking score model. When receiving actual parking data (e.g., probe data, sensor data, etc.) related to the target vehicle 107*a*, the parking score model module 205 fits the actual parking data into the parking score model to determine a corresponding cluster and uses one or more optimal parking locations of the cluster for recommendation. In this case, the parking score model module 205 can apply the optimal parking locations of a similar parking patterns cluster in the model, without any knowledge of the historical parking data of the target area and skipping parking score calculation for parking areas for a target vehicle as performed by the parking score module 203.

In other words, the parking score model module 205 can predict the parking occupancy pattern for a new area, via matching the attributes against the representative cluster representative attributes for each cluster determined above. As such, the parking score model module 205 can use a trained machine learning model to look for a cluster with the most similar features/attributes as the new area. Then, the system 100 makes a prediction of the parking occupancy pattern for the new area. By way of example, when the parking score model is used, the output can be a probability that given a set of features for an area of interest.

In one embodiment, the parking score model module 205 updates the time-dependent parking score model using actual parking data (taken from sensors such as horns honking, visual traffic flow from onboard cameras, time parked vs estimated delivery time needed, etc.), and/or driver survey (via the user interface) collected after the target vehicle 107*a* parked, i.e., as a feedback loop to train the parking score model.

By analogy, similar parking scores and parking score models can be developed for minimize the risk of hindering POI usage (e.g., by pedestrians to a store, concert, etc.), traffic (e.g., on the road, by other vehicles maneuvering around the target vehicle, etc.), etc.

In addition to the above-described on-site parking recommendation for an operating vehicle, the recommendation module 207 can use the parking score model to recommend which day or time of the day for a vehicle task on a given road link, an optimal vehicle size and/or characteristics for the vehicle task in a specific area, etc., to improve fleet managements, transport and logistics services, delivery services, ride hailing services, ride sharing services, etc. By way of example, some areas can fit long delivery trucks while some other areas would see major hindering caused by long vehicles, such that the recommendation module 207 may recommend the use of smaller vehicles for the other areas based on the parking score model.

The vehicles may be manually-driven or autonomous to apply and leverage the above-discussed embodiments to minimize the risk of hindering parking space usage, POI usage, traffic, etc. The main difference would be that autonomous vehicles can move whenever needed without considering driver attributes.

In step 305, the user interface module 209 provides the parking score as an output. In one embodiment, the output can be instructions for an autonomous operation to a vehicle. In another embodiment, the output includes data for presenting the parking score, data for presenting the respective other parking scores, or a combination thereof, to audibly and/or visually present via user interfaces to users. By way of example, FIG. 5A is a diagram 500 illustrating a parking scenario requiring a temporary parking recommendation, according to one embodiment.

Figure 5A:
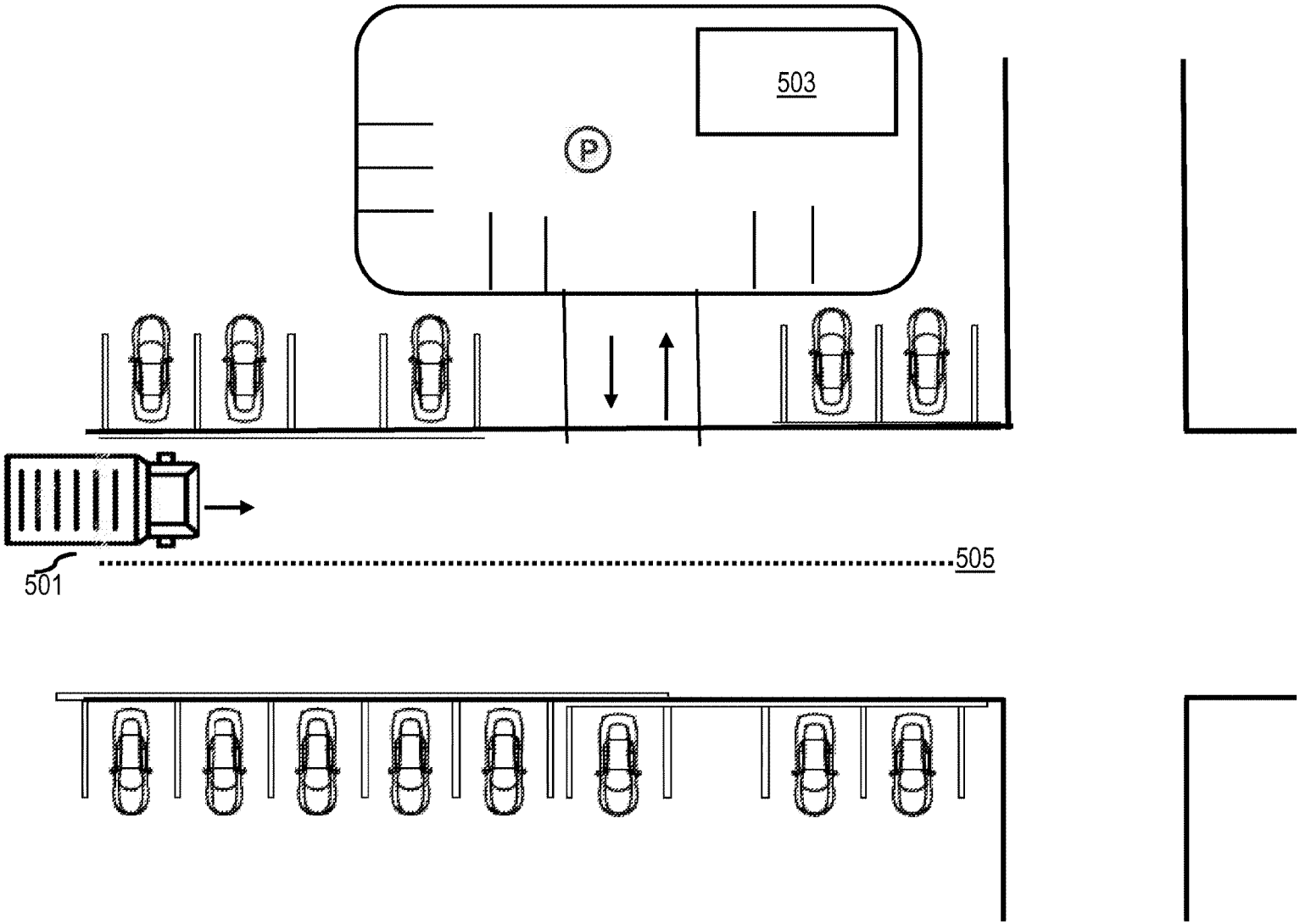
FIG. 5A is a diagram illustrating a parking scenario requiring a temporary parking recommendation, according to one embodiment.

In FIG. 5A, a vehicle 501 approaches a point of interest (e.g., a store 503) along a street 505, and seeks a parking spot to drop off a package. However, a store parking lot is undergoing re-pavement, so the vehicle 501 needs to park on streets, such as the street 505. In one embodiment, the user interface module 209 presents parking recommendations in response to a user request for navigation services (e.g., parking aware routing), mapping services (e.g., presenting a mapping user interface with parking event data), and/or other services for which parking data is processed, used, and/or presented to an end user In another embodiment, the user interface module 209 automatically presents parking recommendations based on driving behaviors (e.g., a parking seeking driving behavior) and/or mobility patterns (e.g., the vehicle drops off packages at the store 503 frequently and/or regularly) of the vehicle 107*a* or the UE 113 associated with the vehicle 107*a*.

In yet another embodiment, after the vehicle 107*a* reaches the recommended parking location and the driver leaves the vehicle 107*a* to make the delivery, the user interface module 209 presents parking alters based upon updated parking data. By way of example, the parking data module 201 detects a situation change (i.e., the parking score drops below a threshold), such as a bicycle is approaching. The user interface module 209 is then triggered to alert the driver to come back to move the vehicle 401*c* as in the scenario of FIG. 4C.

FIGS. 5B-5F are diagrams of example navigation user interfaces presenting parking score data for the parking scenario of FIG. 5A, according to various embodiments. In these figures, the user interfaces present parking recommendations for the vehicle 501 based on parking scores calculated for spaces on the street 505 as three groups: a good-to-park group 511*a* with a parking score range of 0-10 (i.e., that least hinder the parked vehicles to exit occupied spaces and/or other vehicles to use vacant spaces), an intermediate group 511*b* with a parking score range of 11-50, and a not-to-park group 511*c* with a parking score range of 51-100 (i.e., that have a high negative impact on the parking usage and traffic flow in the area).

Figure 5B:
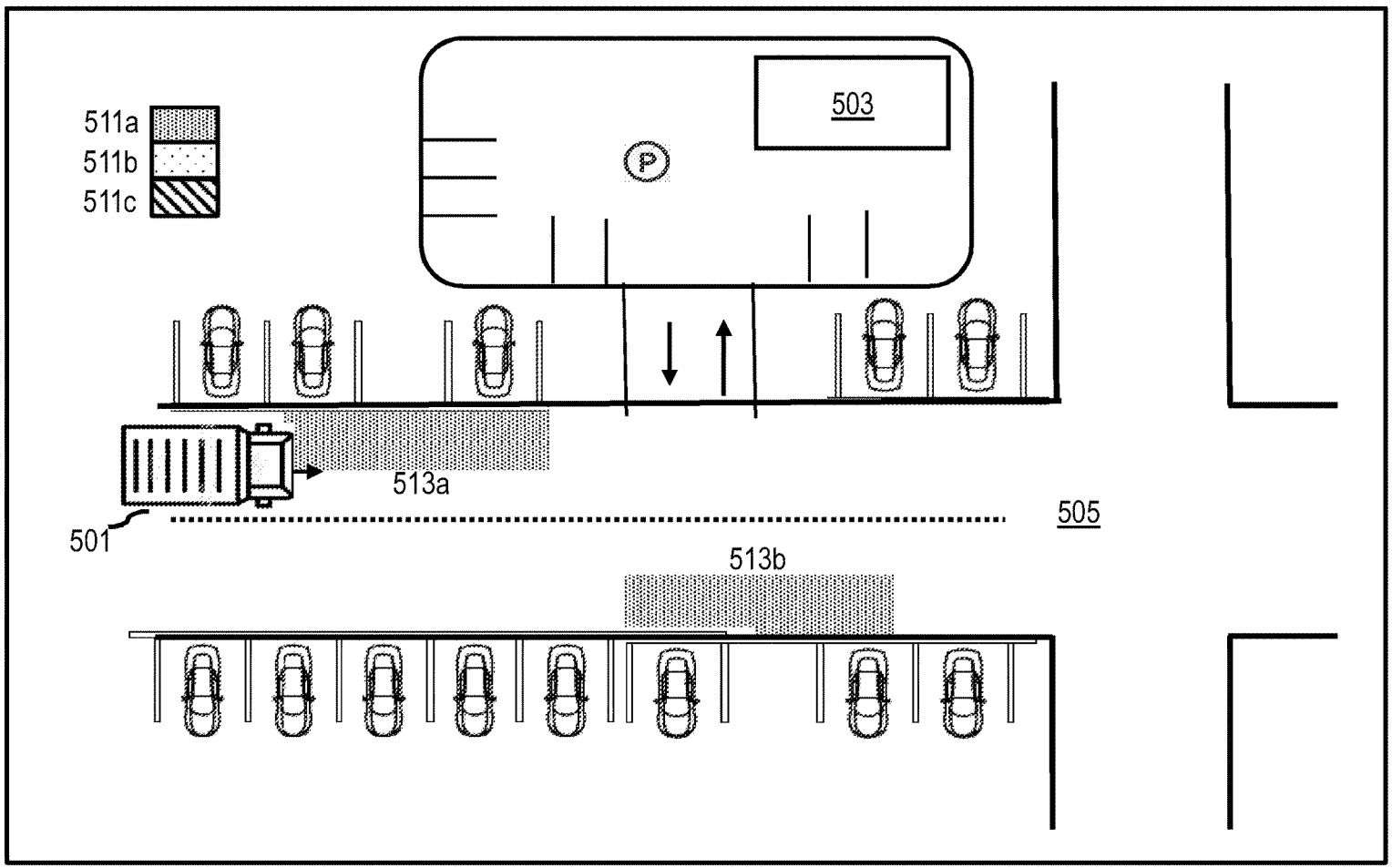
FIGS. 5B-5F are diagrams of example navigation user interfaces presenting parking score data for the parking scenario of FIG. 5A, according to various embodiments.

In FIG. 5B, the user interface 510 presents the parking scores for spaces of a good-to-park group: an area 513*a* that is next to the store parking lot entrance and can hinder one vacant spot and two vehicles, and an area 513*b* that is right across the street 505 from the store parking lot entrance and can hinder another vacant spot and another two vehicles. Each of the areas 513*a*, 513*b* has a parking score in the range of 0-10, since vacant spots are too small to fit in the vehicle 501 and the driver of the vehicle 501 can double-park the vehicle 501 then walk to drop off, for example, two small packages.

Figure 5C:
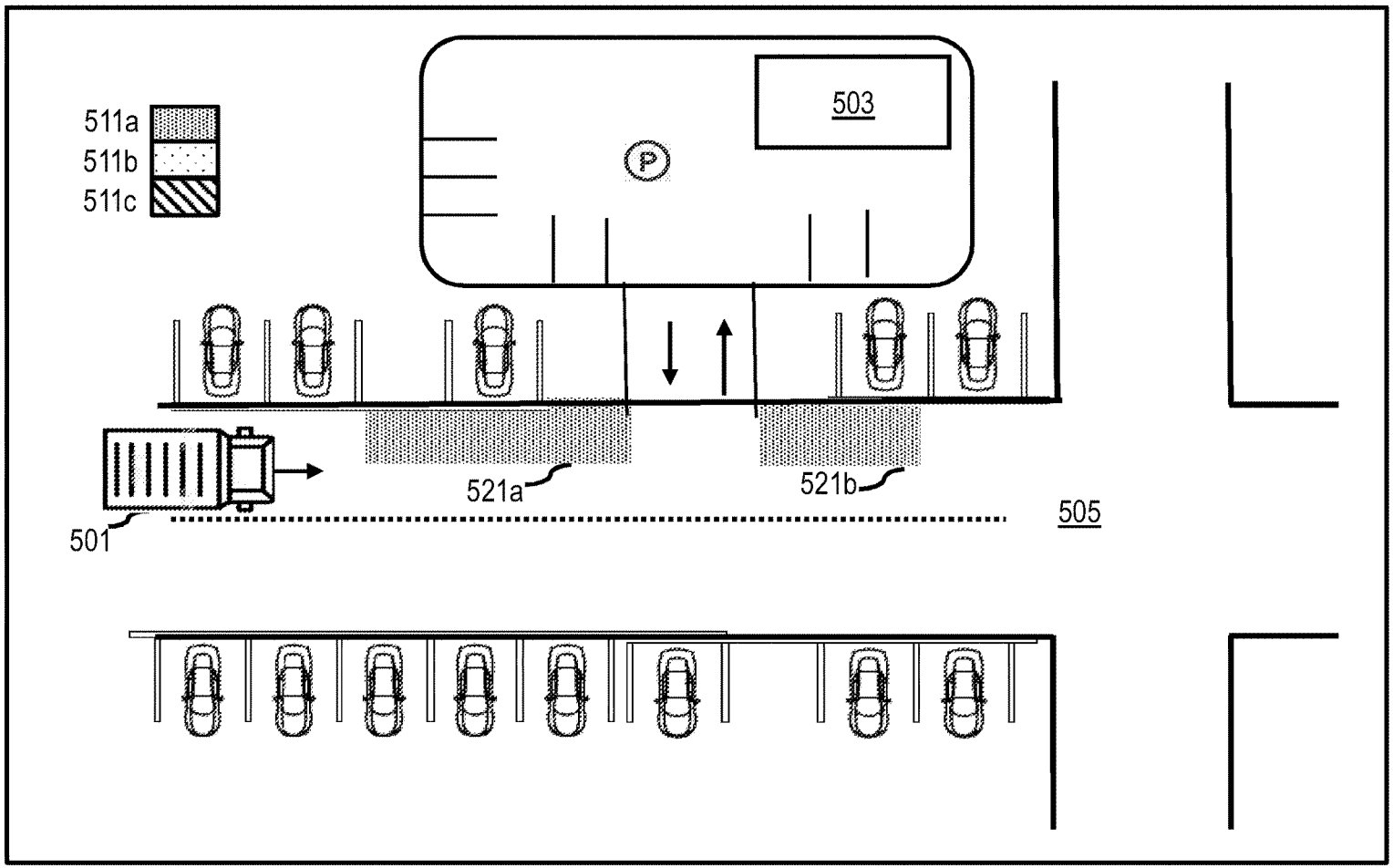

In another embodiment, in FIG. 5C, the user interface 520 presents a different good-to-park group based on other parking data attributes, mobility data attributes, road attributes, other vehicle attributes, driver attributes, passenger attributes, traffic attributes, weather attributes, POI attributes, etc. By way of example, the good-to-park group in FIG. 5C includes an area 521*a* that can hinder a vacant spot and one vehicle as well as one side of the store parking lot entrance, and an area 521*b* that can hinder another vehicle as well as anther side of the store parking lot entrance. Each of the areas 521*a*, 521*b* has a parking score in the range of 0-10, since the driver of the vehicle 501 needs to double-park the vehicle 501 then unload and deliver, for example, three refrigerators.

Figure 5D:
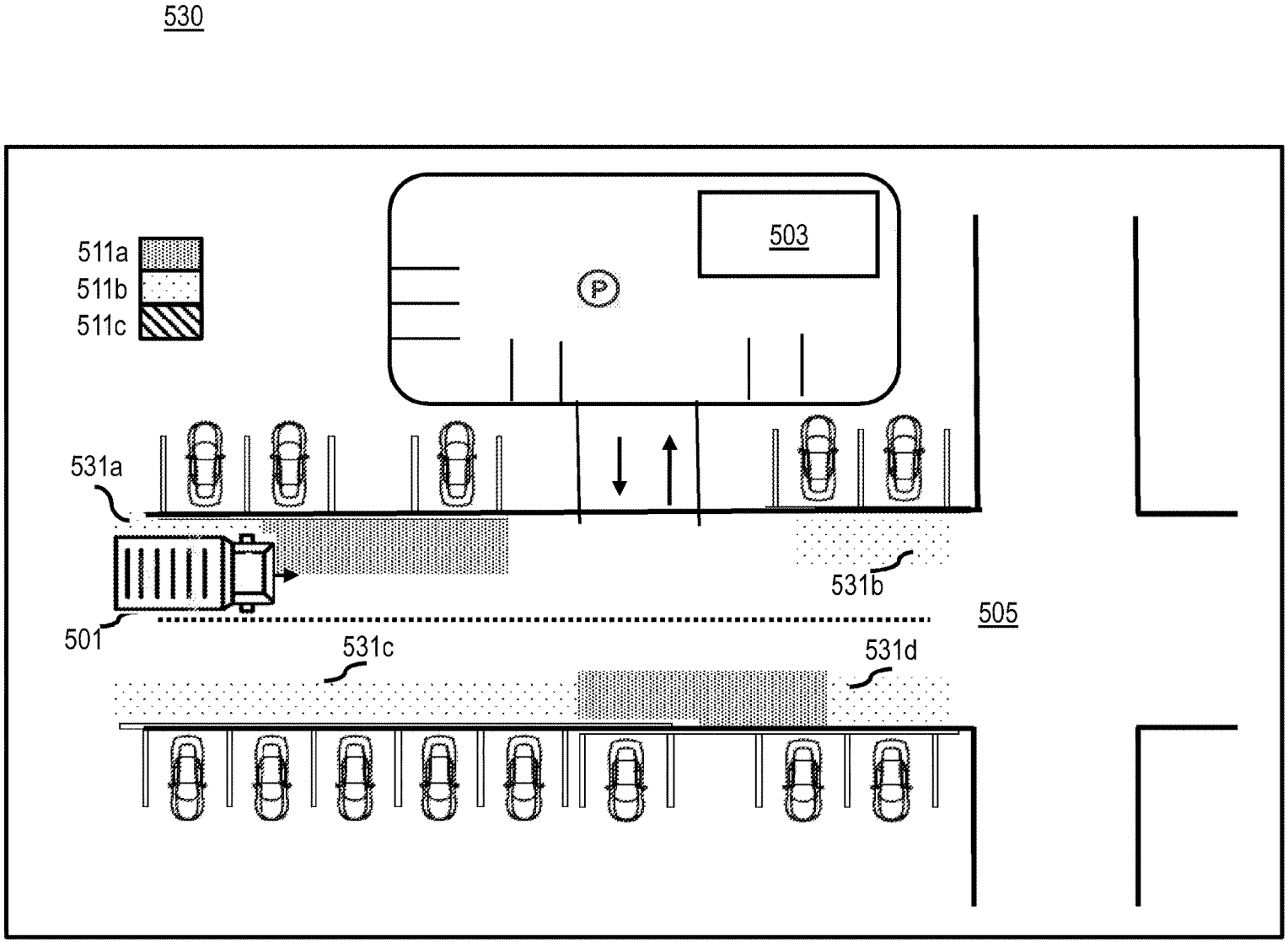

In FIG. 5D, the user interface 530 additionally presents over FIG. 5B the parking scores for spaces of an intermediate group: areas 531*a*-531*d* within the parking score range of 11-50 (e.g., street side area between a good-to-park area and a not-to-park area).

Figure 5E:
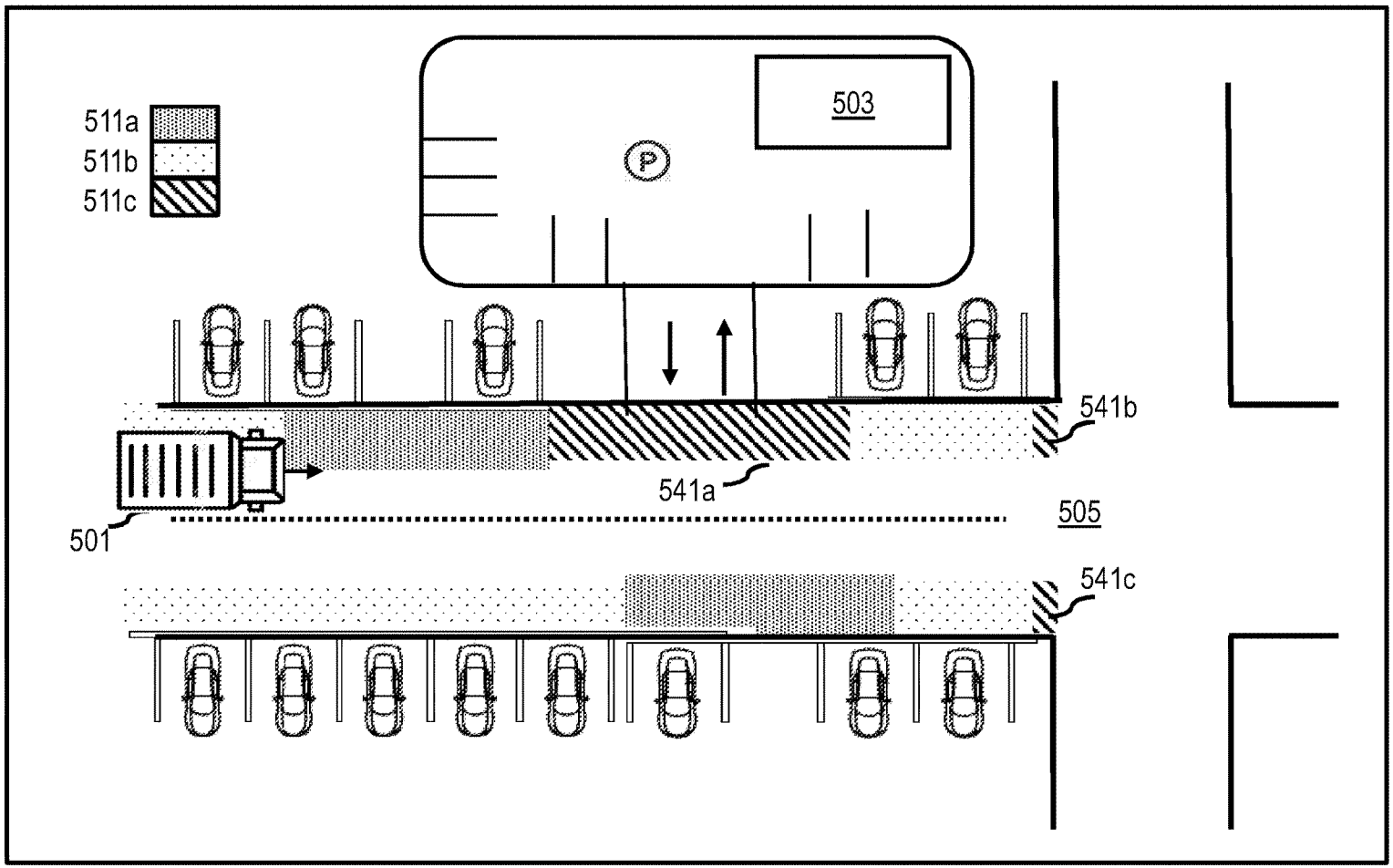
Figure 5F:
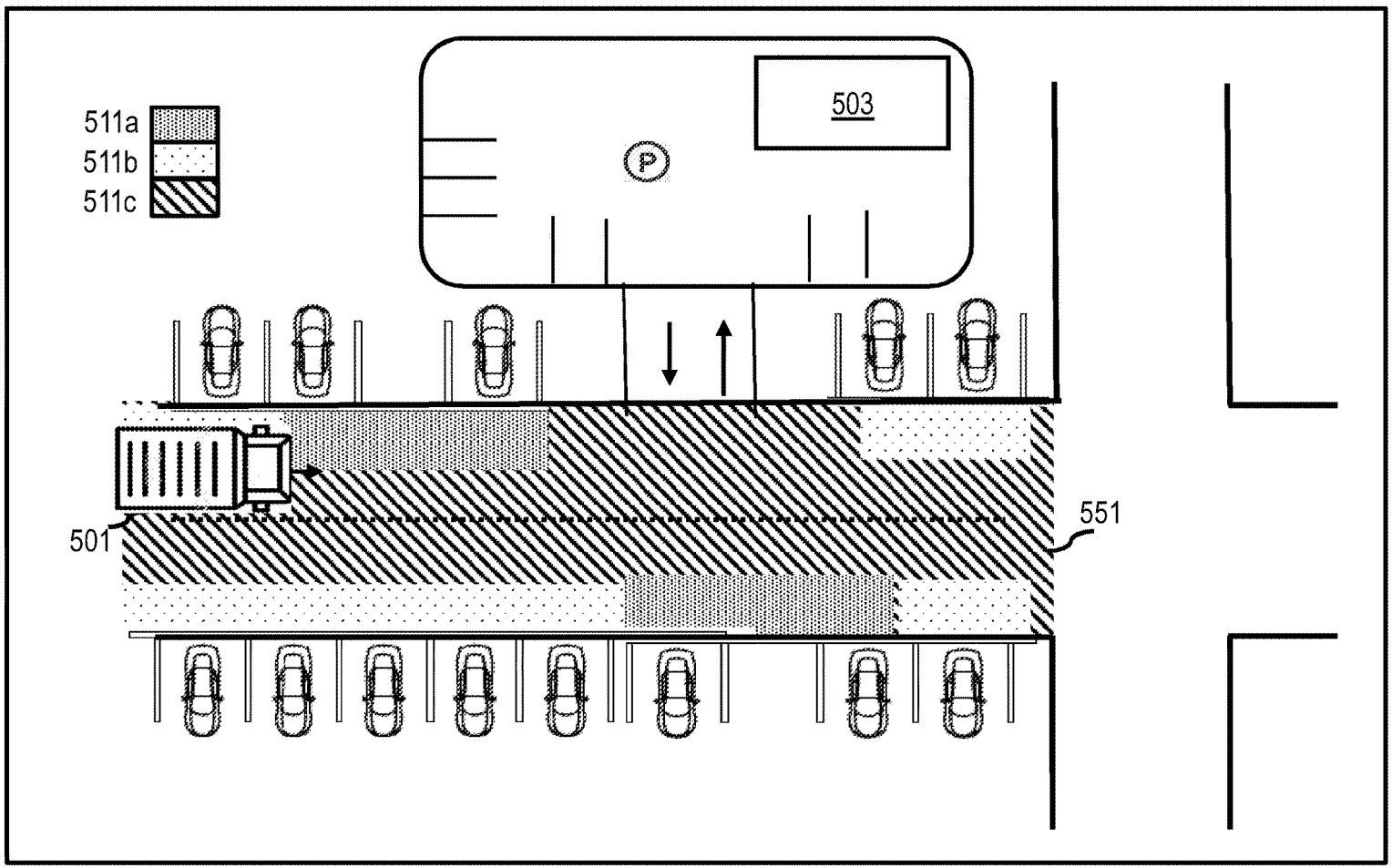

In FIG. 5E, the user interface 540 additionally presents over FIG. 5D the parking scores for spaces of a not-to-park group: areas 541*a*-541*c* with the parking score range of 51-100 (e.g., the store parking lot entrance, the street corners of the street 505, etc.).

When generating a heatmap for a given street (e.g., the street 505), values are computed for all lanes in addition to street side areas. In one embodiment, in FIG. 5F, the user interface 550 additionally presents over FIG. 5E the parking scores for spaces of another not-to-park group including area 551 within the parking score range of 51-100 (e.g., the middle area of the street 505, etc.). In this embodiment, the closer to center lanes/area are generally not be recommended to stop on due to high impact on traffic.

Figure 6:
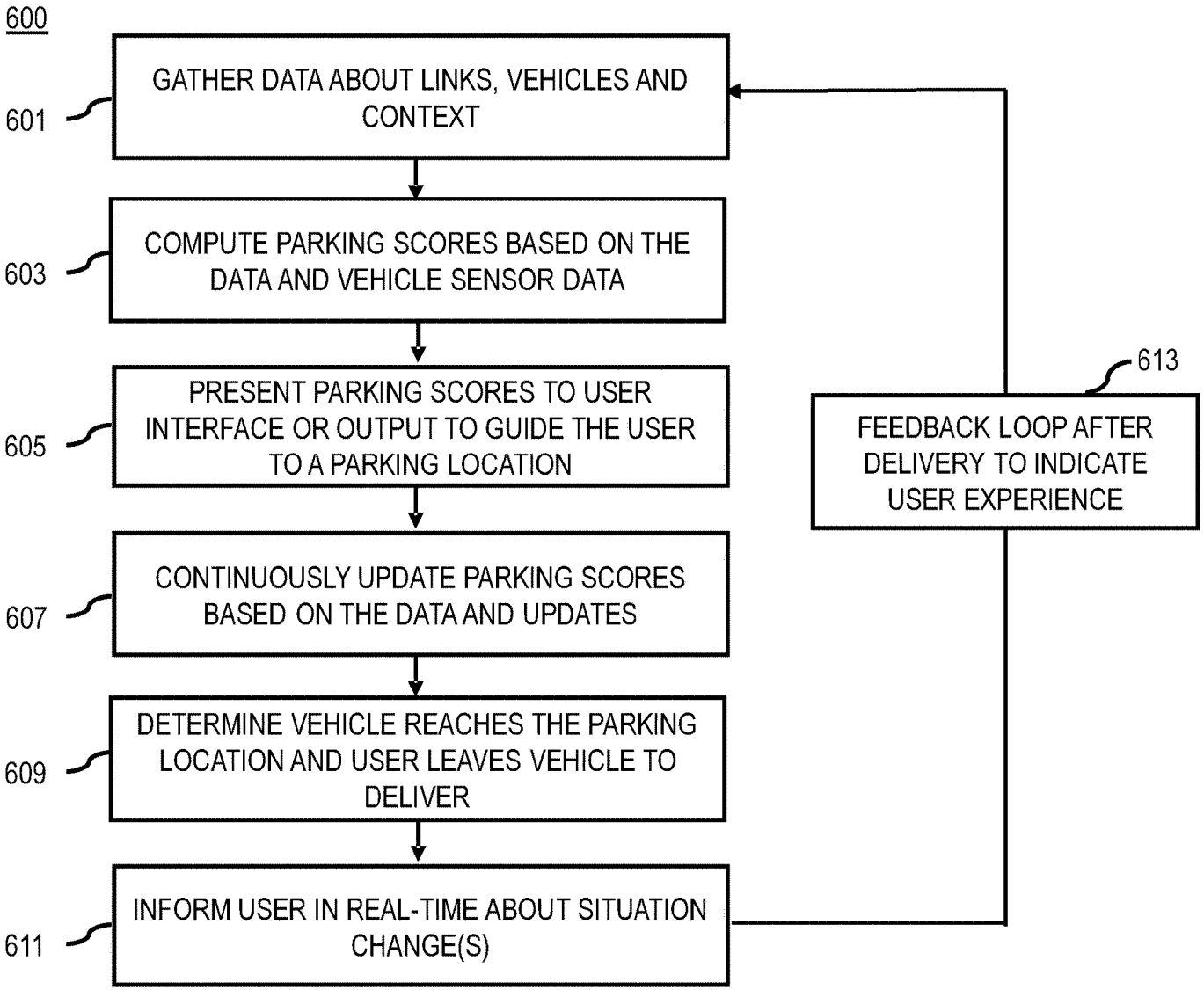
FIG. 6 is a diagram of a process for providing a temporary parking recommendation based on a risk of hindering parking space usage, according to one embodiment.

FIG. 6 is a diagram of a process 600 for providing a temporary parking recommendation based on a risk of hindering parking space usage, according to one embodiment. In step 601, the system 100 gathers static and/or dynamic data about road links, vehicles, context, etc. In step 603, the system 100 dynamically computes parking scores based on the data and additional sensor data, etc. using the above-described embodiments. In step 605, the system 100 presents parking score data to a user interface and/or outputs the parking score data to guide the user to a best/optimal/recommended parking location that least hinders the parked vehicles to exit occupied spaces and/or other vehicles to use vacant spaces.

In step 607, the system 100 continuously or periodically updates the parking score data based on the data and updates, such as before, during and/or after parking the target vehicle 107*a*. In step 609, the system 100 determines that the target vehicle 107*a* reaches the best/optimal/recommended parking location and the user leaves the target vehicle 107*a* to perform a task (e.g., to deliver a package, to pick up a passenger, etc.).

In step 611, the system 100 informs the user in real-time about one or more situation changes (e.g., the parking score of the parked location goes below a threshold), and optionally recommends the user to: quickly finish the task, move the target vehicle 107*a* to a new best/optimal/recommended parking location then finish the task, etc.

In step 613, the system 100 executes a feedback loop after finishing the task to collect user experience. In one embodiment, the system 100 collects user experience via a user interface of the target vehicle 107*a* and/or UE 113. In another embodiment, the system 100 determines user experience based sensor data from the target vehicle 107*a* and/or UE 113 (e.g., horns honking, a visual traffic flow from onboard cameras, time parked vs estimated delivery time, etc.), using machine learning, artificial intelligence, etc.

Figure 7:
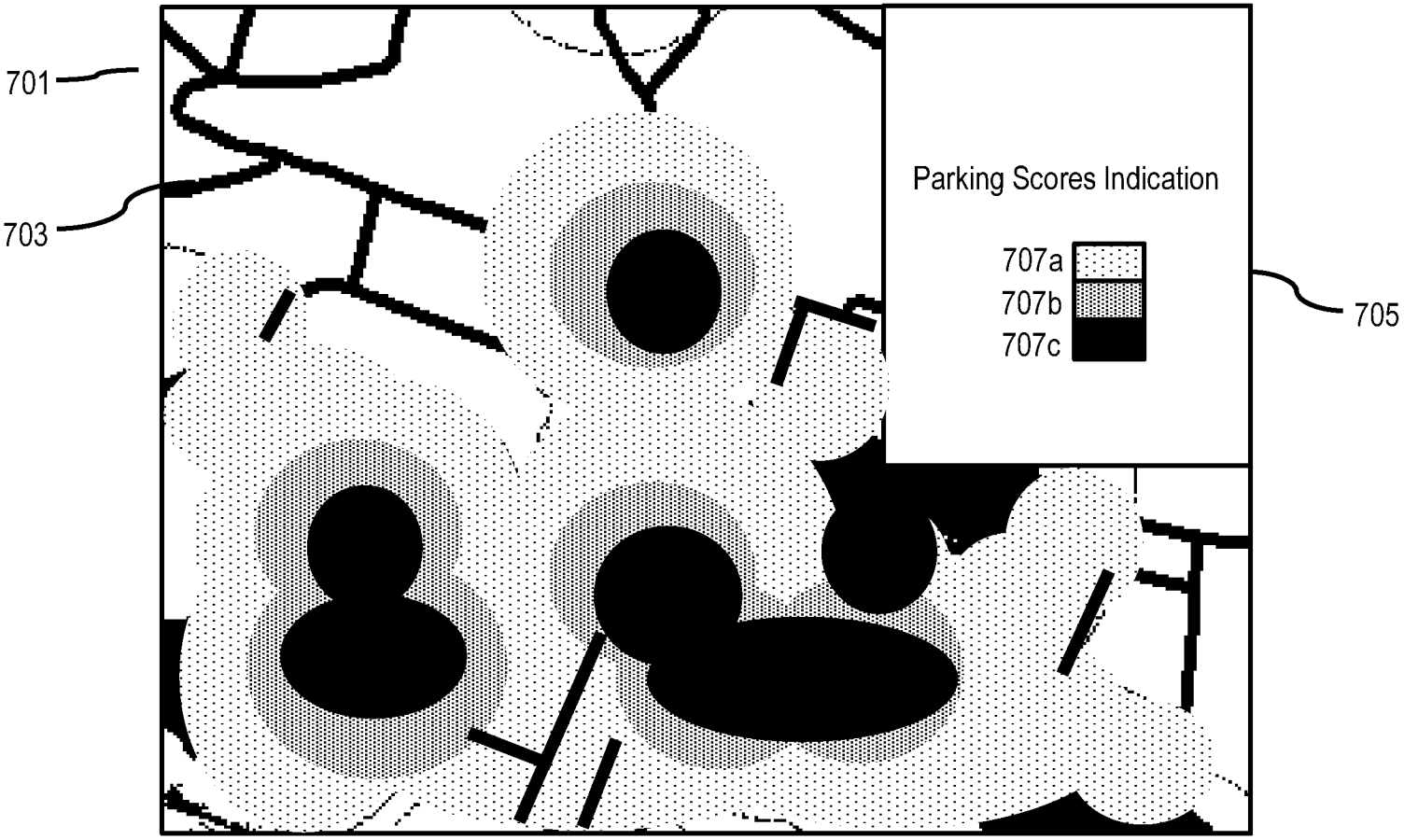
FIG. 7 is a diagram of an example navigation user interface presenting parking score data generated using a parking score model, according to one embodiment.

FIG. 7 is a diagram of an example navigation user interface 700 presenting a parking score heatmap 701 (e.g., presented on vehicle 107*a* and/or UE 113) for a user traveling in a road network, according to one embodiment. By way of example, the heatmap 701 is generated using the parking score model over a road network 703. The user interface 700 further presents a pop-up window 705 with parking score indications transitioning among three groups: a good-to-park group 707*a* with a parking score range of 0-10, an intermediate group 707*b* with a parking score range of 11-50, and a not-to-park group 707*c* with a parking score range of 51-100 based on respective parking scores of different areas. The heatmap 701 and the underlining data can be deployed for fleet managements, transport and logistics services, etc.

The above-mentioned embodiments for parking a terrestrial vehicle can be modified for parking a watercraft (e.g., a boat), or an aerial vehicle (e.g., a drone), etc. The navigation-related functions can correspond to vehicle navigation to an optimal parking space or other types of navigation. While example embodiments described herein generally relate to vehicular travel and parking along roads, example embodiments may be implemented for bicycle travel along bike paths and bike rack/parking scores, boat travel along maritime navigational routes including dock or boat slip ducking scores, drone flying along navigational aerial spaces including hovering over a roof top without colliding with other drones, a space landing scores, etc.

Although various embodiments are described with respect to delivery vehicles, it is contemplated that the approach described herein may be used with other vehicles, such as a private vehicle, shared vehicle, a ride-hailing vehicle, an autonomous vehicle, etc.

Returning to FIG. 1, the system 100 includes the parking platform 111 for performing the processes for providing a temporary parking recommendation based on a risk of hindering parking space usage according to the various embodiments described herein. As shown, the parking platform 111 has connectivity to a parking data infrastructure comprising the parking sensors (e.g., in-ground parking sensors or equivalent) embedded in the parking spaces 103, and the vehicles 107 and/or UE 113 for collecting probe data or location traces from which parking event data can also be determined. The sensors can be any type of sensor capable of detecting when a vehicle 107*a* parks in or leaves a parking space 103 (e.g., embedded magnetic sensors, imaging sensors, etc.), and then storing or transmitting the collected sensor data as parking event data. In addition or alternatively, each vehicle 107 can be equipped with sensors (e.g., location sensors) that can also detect when the vehicle 107*a* parks in or leaves a parking space 103, for storage or transmission as parking event data.

In one embodiment, the vehicles 107 and/or one or more user equipment 113 associated with a vehicle 107*a* can act as probes traveling over a road network represented in the geographic database 109. Although the vehicle 107*a* is depicted as an automobile, it is contemplated that the vehicle 107 can be any type of transportation vehicle manned or unmanned (e.g., motor cycles, buses, trucks, boats, bicycles, etc.) capable of parking in a parking space 103, and the UE 113 can be associated with any of the types of vehicles 107 or a person or thing traveling through the road network of the geographic database 109. For example, the UE 113 can be a standalone device (e.g., mobile phone, portable navigation device, wearable device, etc.) or installed/embedded in the vehicle 107*a*. In one embodiment, the vehicle 107*a* and/or UE 113 may be configured with one or more sensors (such as sensors 117) for determining parking data. By way of example, the sensors 117 may include location sensors (e.g., GPS), accelerometers, compass sensors, gyroscopes, altimeters, etc. In one embodiment, the sensors 117 can also be used to detect and report status data about an operational state of the vehicle 107*a* to assist in determining when the vehicle 107*a* parks in or leaves a parking space 103. For example, a parking event may be detected when it is determined that a vehicle's is engine off, the key is outside of the car, the vehicle door is locked, and/or the like. In one embodiment, the vehicle 107*a* and/or UE 113 are assigned unique probe identifiers (probe ID) for use in reporting or transmitting collected probe data for determining parking event data. The vehicle 107*a* and UE 113, for instance, are part of a probe-based system for collecting probe data for providing a temporary parking recommendation based on a risk of hindering parking space usage according to the various embodiments described herein.

In one embodiment, when a vehicle 107*a* and/or UE 113 (e.g., via a navigation system, navigation application 115, and/or the like) requests instructions to find parking in a given area or location, the parking platform 111 can use the parking score model to determine a parking occupancy pattern for links in which parking is requested. The parking platform 111 can then provide the parking event data to the vehicle 107*a* and/or the UE 113 for presentation in a mapping or navigation user interface. For example, the recommended parking space data can provide a better estimated time of delivery (ETD) to a given POI depending on parking data, to route a driver to a parking space nearest to the POI, etc. The ETD may be used as an estimated parking time which include the time to park, the time to unload packages off the vehicle, the time to move the packages to the POI, the time to return form the POI to the vehicle, etc.

In one embodiment, as noted above, the vehicles 107 are equipped with an embedded navigation systems or other navigation devices (e.g., a UE 113) that are capable of submitting requests for parking information (e.g., parking scores, etc.), and of guiding a driver of the vehicle 107*a* along a navigation route using the parking information. In one embodiment, as the driver navigates along the received route, the vehicles 107 and/or UE 113 (e.g., via a navigation application 115) may receive real-time updates on parking event data predicted for road links or street segments near a destination (e.g., parking spaces within a threshold distance of the destination).

In one embodiment, requests for parking instructions or parking space information can be triggered by interactions with a user interface of the vehicle 107*a* and/or UE 113 (e.g., an explicit request from a user or driver), or automatically when the driver or vehicle 107*a* approaches a target destination (e.g., a set destination, an inferred destination, and/or any other known destination). In yet another embodiment, the vehicle 107*a* and/or UE 113 can initiate a request for parking event data for links of interest when the vehicle 107*a* is detected to have initiated a parking search (e.g., by creating location traces or trajectory data indicating circling, slowing down, multiple U-turns, etc. within an area of the destination). In this way, the parking event data can be provided even when no destination is set or known by the system 100.

In yet another embodiment, the recommended parking space data generated for each new or updated area can be used to build or update the parking score model and/or the geographic database 109. As discussed above, calculating parking scores based parking event data can be resource intensive. As a result, many parking occupancy records for areas stored in the parking score model do not need to be populated, when the system 100 can use the parking score model to estimate parking scores for an area without having to use traditional means (e.g., analysis probe data to determine occupancy data, calculating parking scores based parking event data, etc.).

In one embodiment, the vehicle 107*a* and/or UE 113 are configured to report probe data as probe points, which are individual data records that record telemetry data collected at a point in time. In one embodiment, a probe point can include attributes such as a heading, a speed, a time, or a combination thereof of each of the plurality of devices. At least some of these attributes can also be used as classification features. It is contemplated that any combination of these attributes or other attributes may be recorded as a probe point. As previously discussed, the vehicle 107*a* may include sensors for reporting measurements and/or reporting attributes. The attributes can also be any attribute normally collected by an on-board diagnostic (OBD) system of the vehicle, and available through an interface to the OBD system (e.g., OBD II interface or other similar interface). These attributes can be activation of backup sensors, steering angle, activation of brakes, etc. that can potentially be indicative of parking-related behavior.

In one embodiment, the parking platform 111, the vehicles 107, and/or the UE 113 can interact with a service platform 119, one or more services 121*a*-121*j* (also collectively referred to as services 121), one or more content providers 123*a*-123*k* (also collectively referred to as content providers 123), or a combination thereof over communication network 125 to provide functions and/or services based on the parking score model created according to the various embodiments described herein. The service platform 119, services 121, and/or content providers 123 may provide mapping, navigation, and/or other location based services to the vehicle 107*a* and/or UE 113.

By way of example, the UE 113 may be any mobile computer including, but not limited to, an in-vehicle navigation system, vehicle telemetry device or sensor, a personal navigation device ("PND"), a portable navigation device, a cellular telephone, a mobile phone, a personal digital assistant ("PDA"), a wearable device, a camera, a computer and/or other device that can perform navigation or location based functions, i.e., digital routing and map display. In some embodiments, it is contemplated that mobile computer can refer to a combination of devices such as a cellular telephone that is interfaced with an on-board navigation system of an autonomous vehicle or physically connected to the vehicle for serving as the navigation system.

By way of example, the parking platform 111 may be implemented as a cloud based service, hosted solution or the like for performing the above described functions. Alternatively, the parking platform 111 may be directly integrated for processing data generated and/or provided by the service platform 119, services 121, content providers 123, and/or applications 115. Per this integration, the parking platform 111 may perform client-side parking score model building based on historical parking event data.

By way of example, the communication network 125 of system 100 includes one or more networks such as a data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, code division multiple access (CDMA), wideband code division multiple access (WCDMA), wireless fidelity (WiFi), wireless LAN (WLAN), Bluetooth®, Internet Protocol (IP) data casting, satellite, mobile ad-hoc network (MANET), and the like, or any combination thereof.

By way of example, the parking platform 111 communicates with other components of the system 100 using well known, new or still developing protocols. In this context, a protocol includes a set of rules defining how the network nodes within the communication network 125 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically effected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

The processes described herein for providing a temporary parking recommendation based on a risk of hindering parking space usage may be advantageously implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. Such exemplary hardware for performing the described functions is detailed below.

Figure 8:
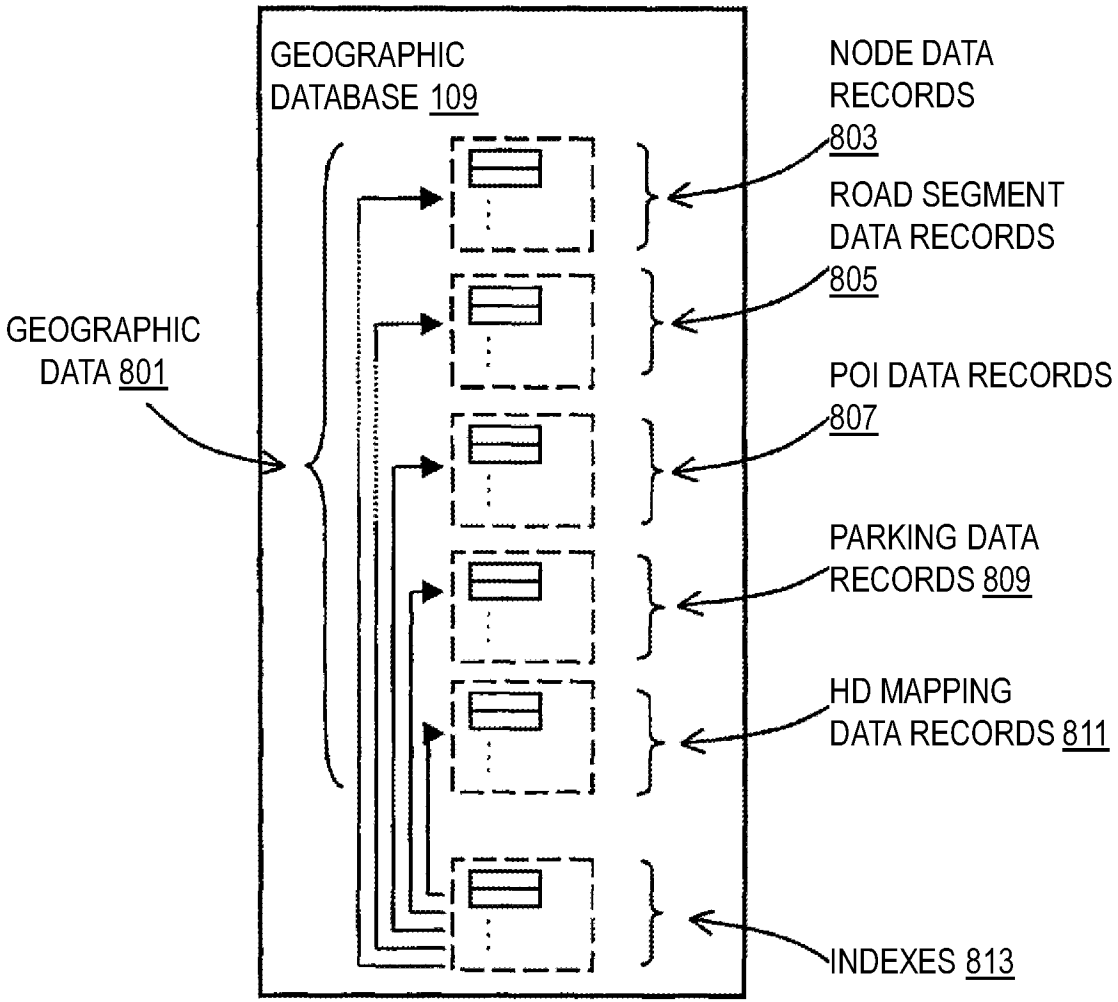
FIG. 8 is a diagram of a geographic database, according to one embodiment.

FIG. 8 is a diagram of a geographic database 109 that can be used in combination with speed data to provide location-based services, according to one embodiment. In one embodiment, the geographic database 109 includes geographic data 801 used for (or configured to be compiled to be used for) mapping and/or navigation-related services, such as for providing map embedding analytics according to the embodiments described herein. For example, the map data records stored herein can be used to determine the semantic relationships among the map features, attributes, categories, etc. represented in the geographic data 801. In one embodiment, the geographic database 109 include high definition (HD) mapping data that provide centimeter-level or better accuracy of map features. For example, the geographic database 109 can be based on Light Detection and Ranging (LiDAR) or equivalent technology to collect billions of 3D points and model road surfaces and other map features down to the number lanes and their widths. In one embodiment, the HD mapping data (e.g., HD data records 811) capture and store details such as the slope and curvature of the road, lane markings, roadside objects such as signposts, including what the signage denotes. By way of example, the HD mapping data enable highly automated vehicles to precisely localize themselves on the road.

In one embodiment, geographic features (e.g., two-dimensional or three-dimensional features) are represented using polylines and/or polygons (e.g., two-dimensional features) or polygon extrusions (e.g., three-dimensional features). In one embodiment, these polylines/polygons can also represent ground truth or reference features or objects (e.g., signs, road markings, lane lines, landmarks, etc.) used for visual odometry. For example, the polylines or polygons can correspond to the boundaries or edges of the respective geographic features. In the case of a building, a two-dimensional polygon can be used to represent a footprint of the building, and a three-dimensional polygon extrusion can be used to represent the three-dimensional surfaces of the building. Accordingly, the terms polygons and polygon extrusions as used herein can be used interchangeably.

In one embodiment, the following terminology applies to the representation of geographic features in the geographic database 109.

"Node"—A point that terminates a link.

"Line segment"—A straight line connecting two points.

"Link" (or "edge")—A contiguous, non-branching string of one or more line segments terminating in a node at each end.

"Shape point"—A point along a link between two nodes (e.g., used to alter a shape of the link without defining new nodes).

"Oriented link"—A link that has a starting node (referred to as the "reference node") and an ending node (referred to as the "non reference node").

"Simple polygon"—An interior area of an outer boundary formed by a string of oriented links that begins and ends in one node. In one embodiment, a simple polygon does not cross itself.

"Polygon"—An area bounded by an outer boundary and none or at least one interior boundary (e.g., a hole or island). In one embodiment, a polygon is constructed from one outer simple polygon and none or at least one inner simple polygon. A polygon is simple if it just consists of one simple polygon, or complex if it has at least one inner simple polygon.

In one embodiment, the geographic database 109 follows certain conventions. For example, links do not cross themselves and do not cross each other except at a node. Also, there are no duplicated shape points, nodes, or links. Two links that connect each other have a common node. In the geographic database 109, overlapping geographic features are represented by overlapping polygons. When polygons overlap, the boundary of one polygon crosses the boundary of the other polygon. In the geographic database 109, the location at which the boundary of one polygon intersects they boundary of another polygon is represented by a node. In one embodiment, a node may be used to represent other locations along the boundary of a polygon than a location at which the boundary of the polygon intersects the boundary of another polygon. In one embodiment, a shape point is not used to represent a point at which the boundary of a polygon intersects the boundary of another polygon.

As shown, the geographic database 109 includes node data records 803, road segment or link data records 805, POI data records 807, parking data records 809, HD mapping data records 811, and indexes 813, for example. More, fewer or different data records can be provided. In one embodiment, additional data records (not shown) can include cartographic ("carto") data records, routing data, and maneuver data. In one embodiment, the indexes 813 may improve the speed of data retrieval operations in the geographic database 109. In one embodiment, the indexes 813 may be used to quickly locate data without having to search every row in the geographic database 109 every time it is accessed. For example, in one embodiment, the indexes 813 can be a spatial index of the polygon points associated with stored feature polygons.

In exemplary embodiments, the road segment data records 805 are links or segments representing roads, streets, or paths, as can be used in the calculated route or recorded route information for determination of one or more personalized routes. The node data records 803 are end points corresponding to the respective links or segments of the road segment data records 805. The road link data records 805 and the node data records 803 represent a road network, such as used by vehicles, cars, and/or other entities. Alternatively, the geographic database 109 can contain path segment and node data records or other data that represent pedestrian paths or areas in addition to or instead of the vehicle road record data, for example. In one embodiment, the nodes and links can make up the base map and that base map can be associated with an HD layer including more detailed information, like lane level details for each road segment or link and how those lanes connect via intersections. Furthermore, another layer may also be provided, such as an HD live map, where road objects are provided in detail in regard to positioning, which can be used for localization. The HD layers can be arranged in a tile format.

The road/link segments and nodes can be associated with attributes, such as geographic coordinates, street names, address ranges, speed limits, turn restrictions at intersections, and other navigation related attributes, as well as POIs, such as gasoline stations, hotels, restaurants, museums, stadiums, offices, automobile dealerships, auto repair shops, buildings, stores, parks, etc. The geographic database 109 can include data about the POIs and their respective locations in the POI data records 807. The geographic database 109 can also include data about places, such as cities, towns, or other communities, and other geographic features, such as bodies of water, mountain ranges, etc. Such place or feature data can be part of the POI data records 807 or can be associated with POIs or POI data records 807 (such as a data point used for displaying or representing a position of a city).

In one embodiment, the geographic database 109 can also include parking data records 809 for storing parking data according to the embodiments described herein. The parking data records 809 can also store related data including but not limited to sensor data, magnetic/vibrational signal data, spectrograms, determine rotational frequencies, and/or any other data used or generated according to the embodiments described herein. By way of example, the parking data records 809 can be associated with one or more of the node records 803, road segment records 805, and/or POI data records 807 to associate the determined vehicle speed data with specific geographic areas or features.

In one embodiment, as discussed above, the HD mapping data records 811 model road surfaces and other map features to centimeter-level or better accuracy (e.g., including centimeter-level accuracy for ground truth objects used for visual odometry based on polyline homogeneity according to the embodiments described herein). The HD mapping data records 811 also include ground truth object models that provide the precise object geometry with polylines or polygonal boundaries, as well as rich attributes of the models. These rich attributes include, but are not limited to, object type, object location, lane traversal information, lane types, lane marking types, lane level speed limit information, and/or the like. In one embodiment, the HD mapping data records 811 are divided into spatial partitions of varying sizes to provide HD mapping data to end user devices with near real-time speed without overloading the available resources of the devices (e.g., computational, memory, bandwidth, etc. resources).

In one embodiment, the HD mapping data records 811 are created from high-resolution 3D mesh or point-cloud data generated, for instance, from LiDAR-equipped vehicles. The 3D mesh or point-cloud data are processed to create 3D representations of a street or geographic environment at centimeter-level accuracy for storage in the HD mapping data records 811.

In one embodiment, the HD mapping data records 811 also include real-time sensor data collected from probe vehicles in the field. The real-time sensor data, for instance, integrates real-time traffic information, weather, and road conditions (e.g., potholes, road friction, road wear, etc.) with highly detailed 3D representations of street and geographic features to provide precise real-time data (e.g., including probe trajectories) also at centimeter-level accuracy. Other sensor data can include vehicle telemetry or operational data such as windshield wiper activation state, braking state, steering angle, accelerator position, and/or the like. The HD mapping data records may be provided as a separate map layer.

In one embodiment, the geographic database 109 can be maintained by the content provider 123 in association with the services platform 119 (e.g., a map developer). The map developer can collect geographic data to generate and enhance the geographic database 109. There can be different ways used by the map developer to collect data. These ways can include obtaining data from other sources, such as municipalities or respective geographic authorities. In addition, the map developer can employ field personnel to travel by vehicle along roads throughout the geographic region to observe features and/or record information about them, for example. Also, remote sensing, such as aerial or satellite photography, can be used.

The geographic database 109 can be a master geographic database stored in a format that facilitates updating, maintenance, and development. For example, the master geographic database or data in the master geographic database can be in an Oracle spatial format or other spatial format, such as for development or production purposes. The Oracle spatial format or development/production database can be compiled into a delivery format, such as a geographic data files (GDF) format. Other formats including tile structures for different map layers may be used for different delivery techniques. The data in the production and/or delivery formats can be compiled or further compiled to form geographic database products or databases, which can be used in end user navigation devices or systems.

For example, geographic data is compiled (such as into a platform specification format (PSF)) to organize and/or configure the data for performing navigation-related functions and/or services, such as route calculation, route guidance, map display, speed calculation, distance and travel time functions, and other functions, by a navigation device, such as by a vehicle 107 and/or UE 113. The navigation-related functions can correspond to vehicle navigation, pedestrian navigation, or other types of navigation. The compilation to produce the end user databases can be performed by a party or entity separate from the map developer. For example, a customer of the map developer, such as a navigation device developer or other end user device developer, can perform compilation on a received geographic database in a delivery format to produce one or more compiled navigation databases.

The processes described herein for providing a temporary parking recommendation based on a risk of hindering parking space usage may be advantageously implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. Such exemplary hardware for performing the described functions is detailed below.

Figure 9:
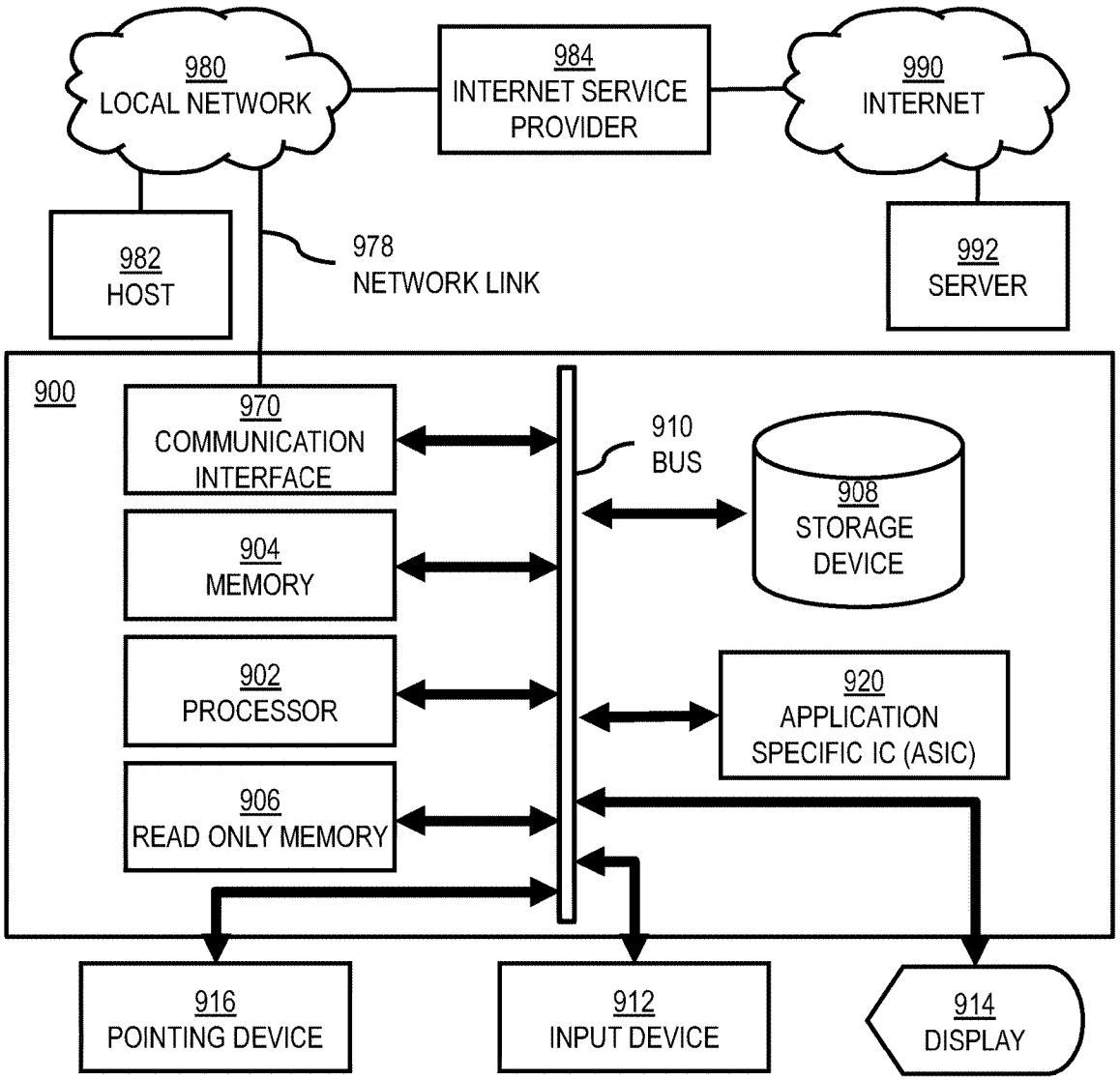
FIG. 9 is a diagram of hardware that can be used to implement an embodiment.

FIG. 9 illustrates a computer system 900 upon which an embodiment of the invention may be implemented. Computer system 900 is programmed (e.g., via computer program code or instructions) to provide a temporary parking recommendation based on a risk of hindering parking space usage as described herein and includes a communication mechanism such as a bus 910 for passing information between other internal and external components of the computer system 900. Information (also called data) is represented as a physical expression of a measurable phenomenon, typically electric voltages, but including, in other embodiments, such phenomena as magnetic, electromagnetic, pressure, chemical, biological, molecular, atomic, sub-atomic and quantum interactions. For example, north and south magnetic fields, or a zero and non-zero electric voltage, represent two states (0, 1) of a binary digit (bit). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range.

A bus 910 includes one or more parallel conductors of information so that information is transferred quickly among devices coupled to the bus 910. One or more processors 902 for processing information are coupled with the bus 910.

A processor 902 performs a set of operations on information as specified by computer program code related to providing a temporary parking recommendation based on a risk of hindering parking space usage. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 910 and placing information on the bus 910. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 902, such as a sequence of operation codes, constitute processor instructions, also called computer system instructions or, simply, computer instructions. Processors may be implemented as mechanical, electrical, magnetic, optical, chemical or quantum components, among others, alone or in combination.

Computer system 900 also includes a memory 904 coupled to bus 910. The memory 904, such as a random access memory (RAM) or other dynamic storage device, stores information including processor instructions for providing a temporary parking recommendation based on a risk of hindering parking space usage. Dynamic memory allows information stored therein to be changed by the computer system 900. RAM allows a unit of information stored at a location called a memory address to be stored and retrieved independently of information at neighboring addresses. The memory 904 is also used by the processor 902 to store temporary values during execution of processor instructions. The computer system 900 also includes a read only memory (ROM) 906 or other static storage device coupled to the bus 910 for storing static information, including instructions, that is not changed by the computer system 900. Some memory is composed of volatile storage that loses the information stored thereon when power is lost. Also coupled to bus 910 is a non-volatile (persistent) storage device 908, such as a magnetic disk, optical disk or flash card, for storing information, including instructions, that persists even when the computer system 900 is turned off or otherwise loses power.

Information, including instructions for providing a temporary parking recommendation based on a risk of hindering parking space usage, is provided to the bus 910 for use by the processor from an external input device 912, such as a keyboard containing alphanumeric keys operated by a human user, or a sensor. A sensor detects conditions in its vicinity and transforms those detections into physical expression compatible with the measurable phenomenon used to represent information in computer system 900. Other external devices coupled to bus 910, used primarily for interacting with humans, include a display device 914, such as a cathode ray tube (CRT) or a liquid crystal display (LCD), or plasma screen or printer for presenting text or images, and a pointing device 916, such as a mouse or a trackball or cursor direction keys, or motion sensor, for controlling a position of a small cursor image presented on the display 914 and issuing commands associated with graphical elements presented on the display 914. In some embodiments, for example, in embodiments in which the computer system 900 performs all functions automatically without human input, one or more of external input device 912, display device 914 and pointing device 916 is omitted.

In the illustrated embodiment, special purpose hardware, such as an application specific integrated circuit (ASIC) 920, is coupled to bus 910. The special purpose hardware is configured to perform operations not performed by processor 902 quickly enough for special purposes. Examples of application specific ICs include graphics accelerator cards for generating images for display 914, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 900 also includes one or more instances of a communications interface 970 coupled to bus 910. Communication interface 970 provides a one-way or two-way communication coupling to a variety of external devices that operate with their own processors, such as printers, scanners and external disks. In general the coupling is with a network link 978 that is connected to a local network 980 to which a variety of external devices with their own processors are connected. For example, communication interface 970 may be a parallel port or a serial port or a universal serial bus (USB) port on a personal computer. In some embodiments, communications interface 970 is an integrated services digital network (ISDN) card or a digital subscriber line (DSL) card or a telephone modem that provides an information communication connection to a corresponding type of telephone line. In some embodiments, a communication interface 970 is a cable modem that converts signals on bus 910 into signals for a communication connection over a coaxial cable or into optical signals for a communication connection over a fiber optic cable. As another example, communications interface 970 may be a local area network (LAN) card to provide a data communication connection to a compatible LAN, such as Ethernet. Wireless links may also be implemented. For wireless links, the communications interface 970 sends or receives or both sends and receives electrical, acoustic or electromagnetic signals, including infrared and optical signals, that carry information streams, such as digital data. For example, in wireless handheld devices, such as mobile telephones like cell phones, the communications interface 970 includes a radio band electromagnetic transmitter and receiver called a radio transceiver. In certain embodiments, the communications interface 970 enables connection to the communication network 125 for providing a temporary parking recommendation based on a risk of hindering parking space usage to the vehicle 107 and/or the UE 113.

The term computer-readable medium is used herein to refer to any medium that participates in providing information to processor 902, including instructions for execution. Such a medium may take many forms, including, but not limited to, non-volatile media, volatile media and transmission media. Non-volatile media include, for example, optical or magnetic disks, such as storage device 908. Volatile media include, for example, dynamic memory 904. Transmission media include, for example, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, any other memory chip or cartridge, a carrier wave, or any other medium from which a computer can read.

Network link 978 typically provides information communication using transmission media through one or more networks to other devices that use or process the information. For example, network link 978 may provide a connection through local network 980 to a host computer 982 or to equipment 984 operated by an Internet Service Provider (ISP). ISP equipment 984 in turn provides data communication services through the public, world-wide packet-switching communication network of networks now commonly referred to as the Internet 990.

A computer called a server host 992 connected to the Internet hosts a process that provides a service in response to information received over the Internet. For example, server host 992 hosts a process that provides information representing video data for presentation at display 914. It is contemplated that the components of system can be deployed in various configurations within other computer systems, e.g., host 982 and server 992.

FIG. 10 illustrates a chip set 1000 upon which an embodiment of the invention may be implemented. Chip set 1000 is programmed to provide a temporary parking recommendation based on a risk of hindering parking space usage as described herein and includes, for instance, the processor and memory components described with respect to FIG. 9 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip.

In one embodiment, the chip set 1000 includes a communication mechanism such as a bus 1001 for passing information among the components of the chip set 1000. A processor 1003 has connectivity to the bus 1001 to execute instructions and process information stored in, for example, a memory 1005. The processor 1003 may include one or more processing cores with each core configured to perform independently. A multi-core processor enables multiprocessing within a single physical package. Examples of a multi-core processor include two, four, eight, or greater numbers of processing cores. Alternatively or in addition, the processor 1003 may include one or more microprocessors configured in tandem via the bus 1001 to enable independent execution of instructions, pipelining, and multithreading. The processor 1003 may also be accompanied with one or more specialized components to perform certain processing functions and tasks such as one or more digital signal processors (DSP) 1007, or one or more application-specific integrated circuits (ASIC) 1009. A DSP 1007 typically is configured to process real-world signals (e.g., sound) in real time independently of the processor 1003. Similarly, an ASIC 1009 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 1003 and accompanying components have connectivity to the memory 1005 via the bus 1001. The memory 1005 includes both dynamic memory (e.g., RAM, magnetic disk, writable optical disk, etc.) and static memory (e.g., ROM, CD-ROM, etc.) for storing executable instructions that when executed perform the inventive steps described herein to provide a temporary parking recommendation based on a risk of hindering parking space usage. The memory 1005 also stores the data associated with or generated by the execution of the inventive steps.

Figure 11:
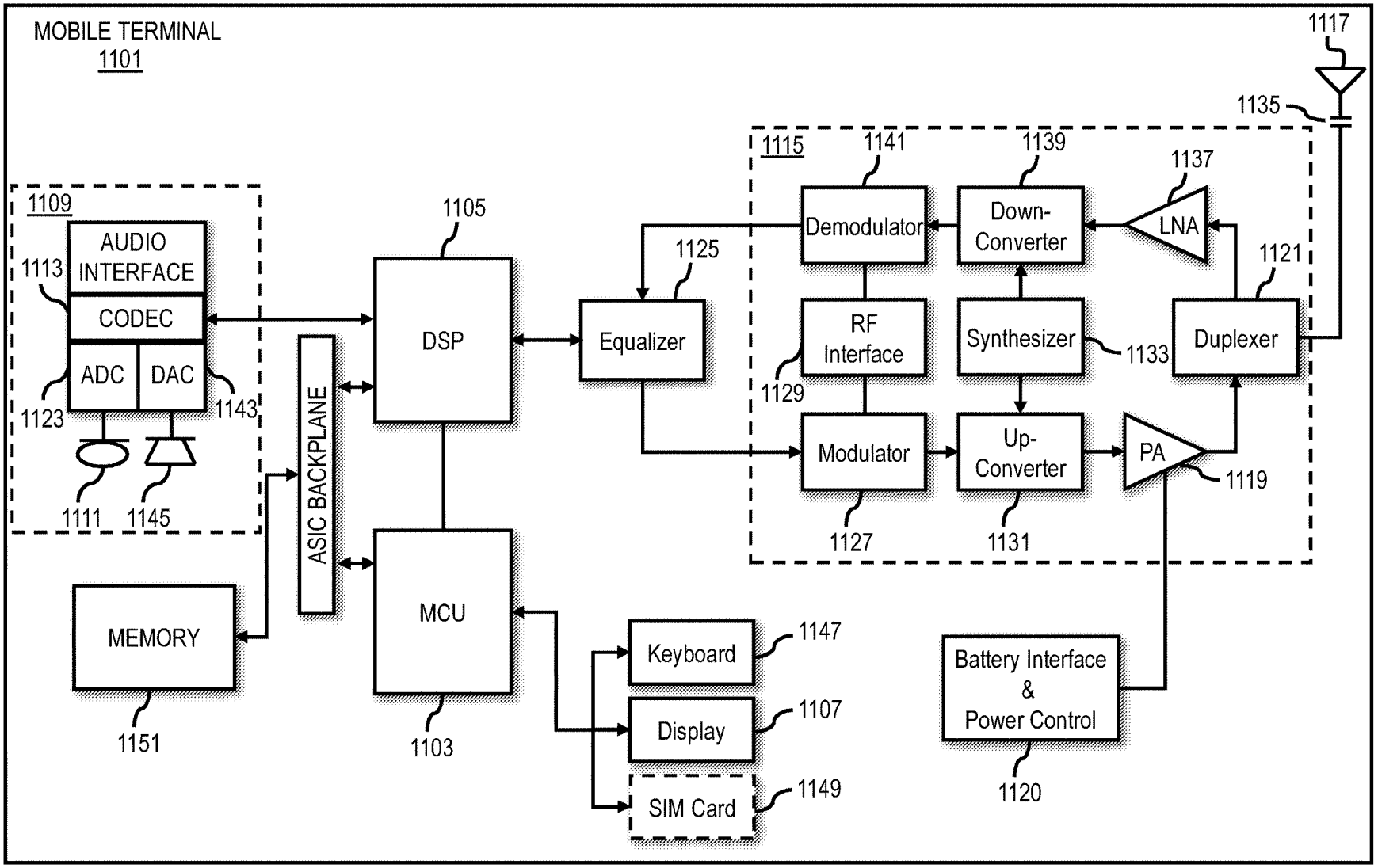
FIG. 11 is a diagram of a mobile terminal (e.g., mobile computer or vehicle or part thereof) that can be used to implement an embodiment.

FIG. 11 is a diagram of exemplary components of a mobile terminal 1101 (e.g., handset or vehicle or part thereof) capable of operating in the system of FIG. 1, according to one embodiment. Generally, a radio receiver is often defined in terms of front-end and back-end characteristics. The front-end of the receiver encompasses all of the Radio Frequency (RF) circuitry whereas the back-end encompasses all of the base-band processing circuitry. Pertinent internal components of the telephone include a Main Control Unit (MCU) 1103, a Digital Signal Processor (DSP) 1105, and a receiver/transmitter unit including a microphone gain control unit and a speaker gain control unit. A main display unit 1107 provides a display to the user in support of various applications and mobile station functions that offer automatic contact matching. An audio function circuitry 1109 includes a microphone 1111 and microphone amplifier that amplifies the speech signal output from the microphone 1111. The amplified speech signal output from the microphone 1111 is fed to a coder/decoder (CODEC) 1113.

A radio section 1115 amplifies power and converts frequency in order to communicate with a base station, which is included in a mobile communication system, via antenna 1117. The power amplifier (PA) 1119 and the transmitter/modulation circuitry are operationally responsive to the MCU 1103, with an output from the PA 1119 coupled to the duplexer 1121 or circulator or antenna switch, as known in the art. The PA 1119 also couples to a battery interface and power control unit 1120.

In use, a user of mobile station 1101 speaks into the microphone 1111 and his or her voice along with any detected background noise is converted into an analog voltage. The analog voltage is then converted into a digital signal through the Analog to Digital Converter (ADC) 1123. The control unit 1103 routes the digital signal into the DSP 1105 for processing therein, such as speech encoding, channel encoding, encrypting, and interleaving. In one embodiment, the processed voice signals are encoded, by units not separately shown, using a cellular transmission protocol such as global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., microwave access (WiMAX), Long Term Evolution (LTE) networks, code division multiple access (CDMA), wireless fidelity (WiFi), satellite, and the like.

The encoded signals are then routed to an equalizer 1125 for compensation of any frequency-dependent impairments that occur during transmission though the air such as phase and amplitude distortion. After equalizing the bit stream, the modulator 1127 combines the signal with a RF signal generated in the RF interface 1129. The modulator 1127 generates a sine wave by way of frequency or phase modulation. In order to prepare the signal for transmission, an up-converter 1131 combines the sine wave output from the modulator 1127 with another sine wave generated by a synthesizer 1133 to achieve the desired frequency of transmission. The signal is then sent through a PA 1119 to increase the signal to an appropriate power level. In practical systems, the PA 1119 acts as a variable gain amplifier whose gain is controlled by the DSP 1105 from information received from a network base station. The signal is then filtered within the duplexer 1121 and optionally sent to an antenna coupler 1135 to match impedances to provide maximum power transfer. Finally, the signal is transmitted via antenna 1117 to a local base station. An automatic gain control (AGC) can be supplied to control the gain of the final stages of the receiver. The signals may be forwarded from there to a remote telephone which may be another cellular telephone, other mobile phone or a land-line connected to a Public Switched Telephone Network (PSTN), or other telephony networks.

Voice signals transmitted to the mobile station 1101 are received via antenna 1117 and immediately amplified by a low noise amplifier (LNA) 1137. A down-converter 1139 lowers the carrier frequency while the demodulator 1141 strips away the RF leaving only a digital bit stream. The signal then goes through the equalizer 1125 and is processed by the DSP 1105. A Digital to Analog Converter (DAC) 1143 converts the signal and the resulting output is transmitted to the user through the speaker 1145, all under control of a Main Control Unit (MCU) 1103—which can be implemented as a Central Processing Unit (CPU) (not shown).

The MCU 1103 receives various signals including input signals from the keyboard 1147. The keyboard 1147 and/or the MCU 1103 in combination with other user input components (e.g., the microphone 1111) comprise a user interface circuitry for managing user input. The MCU 1103 runs a user interface software to facilitate user control of at least some functions of the mobile station 1101 to provide a temporary parking recommendation based on a risk of hindering parking space usage. The MCU 1103 also delivers a display command and a switch command to the display 1107 and to the speech output switching controller, respectively. Further, the MCU 1103 exchanges information with the DSP 1105 and can access an optionally incorporated SIM card 1149 and a memory 1151. In addition, the MCU 1103 executes various control functions required of the station. The DSP 1105 may, depending upon the implementation, perform any of a variety of conventional digital processing functions on the voice signals. Additionally, DSP 1105 determines the background noise level of the local environment from the signals detected by microphone 1111 and sets the gain of microphone 1111 to a level selected to compensate for the natural tendency of the user of the mobile station 1101.

The CODEC 1113 includes the ADC 1123 and DAC 1143. The memory 1151 stores various data including call incoming tone data and is capable of storing other data including music data received via, e.g., the global Internet. The software module could reside in RAM memory, flash memory, registers, or any other form of writable computer-readable storage medium known in the art including non-transitory computer-readable storage medium. For example, the memory device 1151 may be, but not limited to, a single memory, CD, DVD, ROM, RAM, EEPROM, optical storage, or any other non-volatile or non-transitory storage medium capable of storing digital data.

An optionally incorporated SIM card 1149 carries, for instance, important information, such as the cellular phone number, the carrier supplying service, subscription details, and security information. The SIM card 1149 serves primarily to identify the mobile station 1101 on a radio network. The card 1149 also contains a memory for storing a personal telephone number registry, text messages, and user specific mobile station settings.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A method for providing a temporary parking recommendation based on hindering one or more parking spots comprising:

determining parking data for the one or more parking spots that are within a designated proximity of a location in a road network;

calculating a parking score for the location based on the parking data, wherein the parking score represents a risk that a vehicle parking at the location will hinder at least one other vehicle when the at least one other vehicle attempts to enter or exit the one or more parking spots; and providing data for presenting the parking score as an output.

2. The method of claim 1, further comprising:

determining the temporary parking recommendation for the vehicle based on the parking score for the location.

3. The method of claim 2, further comprising:

segmenting the road network into a plurality of geographic areas, wherein the location corresponds to at least one geographic area of the plurality of geographic areas; and generating respective other parking scores for one or more other geographic areas of the plurality of geographic areas, wherein the parking recommendation is further based on the respective other parking scores.

4. The method of claim 3, wherein the data for presenting the parking score includes data for presenting the respective other parking scores.

5. The method of claim 4, wherein the data is used to present a user interface displaying one or more representations of the parking score, the respective other parking scores, or a combination thereof.

6. The method of claim 2, wherein the vehicle is a delivery vehicle, and wherein the parking recommendation is further based on at least one delivery attribute of the delivery vehicle.

7. The method of claim 6, wherein the at least one delivery attribute includes a package to be delivered, a location of a delivery, a size of the delivery vehicle, a next stop of the delivery vehicle, a maneuverability of the delivery vehicle, a line of sight of the delivery vehicle to the location of the delivery, or a combination thereof.

8. The method of claim 1, wherein the parking data includes a churn rate.

9. The method of claim 1, further comprising:

processing mobility data associated with the location, the road network, the one or more parking spots, or a combination thereof to determine a predicted time when the at least one other vehicle is expected to enter or exit the one or more parking spots, wherein the parking score is further based on the predicted time.

10. The method of claim 1, wherein the parking score is further based on at least one of:

parking restriction data;

traffic data;

weather data;

road attribute data;

a population model of the location; and sensor data collected from the vehicle.

11. The method of claim 1, wherein the location has not previously been designated as a parking spot.

12. The method of claim 1, wherein the vehicle is a terrestrial vehicle or an aerial vehicle.

13. The method of claim 1, wherein the parking score further represents a risk that the vehicle parking at the location will hinder at least one other vehicle travelling in the road network.

14. An apparatus for providing a temporary parking recommendation based on hindering one or more parking spots, comprising:

at least one processor; and at least one memory including computer program code for one or more programs, the at least one memory and the computer program code configured to, with the at least one processor, cause the apparatus to perform at least the following, determine parking data for the one or more parking spots that are within a designated proximity of a location in a road network;

calculate a parking score for the location based on the parking data, wherein the parking score represents a risk that a vehicle parking at the location will hinder at least one other vehicle when the at least one other vehicle attempts to enter or exit the one or more parking spots; and determining the temporary parking recommendation for the vehicle based on the parking score for the location.

15. The apparatus of claim 14, wherein the apparatus is further caused to:

segment the road network into a plurality of geographic areas, wherein the location corresponds to at least one geographic area of the plurality of geographic areas; and generate respective other parking scores for one or more other geographic areas of the plurality of geographic areas, wherein the parking recommendation is further based on the respective other parking scores.

16. The apparatus of claim 15, wherein the apparatus is further caused to:

initiate a presentation of a user interface displaying one or more representations of the parking score, the respective other parking scores, or a combination thereof as a heatmap.

17. The apparatus of claim 16, wherein the apparatus is further caused to:

initiate a presentation of the parking recommendation over the heatmap.

18. A non-transitory computer-readable storage medium for providing a temporary parking recommendation based on hindering one or more parking spots, carrying one or more sequences of one or more instructions which, when executed by one or more processors, cause an apparatus to at least perform the following steps:

determining parking data for the one or more parking spots that are within a designated proximity of a location in a road network;

calculating a parking score for the location based on the parking data, wherein the parking score represents a risk that a vehicle parking at the location will hinder at least one other vehicle when the at least one other vehicle attempts to enter or exit the one or more parking spots; and providing data for presenting the parking score, the location, or a combination thereof to a delivery vehicle.

19. The non-transitory computer-readable storage medium of claim 18, further comprising:

determining the temporary parking recommendation for the delivery vehicle based on the parking score for the location, wherein the parking recommendation is further based on at least one delivery attribute of the delivery vehicle.

20. The non-transitory computer-readable storage medium of claim 19, wherein the at least one delivery attribute includes a package to be delivered, a location of a delivery, a size of the delivery vehicle, a next stop of the delivery vehicle, a maneuverability of the delivery vehicle, a line of sight of the delivery vehicle to the location of the delivery, or a combination thereof.

* * * * *